US010891903B2

(12) United States Patent
Takasugi

(10) Patent No.: US 10,891,903 B2
(45) Date of Patent: Jan. 12, 2021

(54) GATE-IN-PANEL GATE DRIVER AND ORGANIC LIGHT EMITTING DISPLAY DEVICE HAVING THE SAME

(71) Applicant: LG Display Co., Ltd., Seoul (KR)

(72) Inventor: Shinji Takasugi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 12 days.

(21) Appl. No.: 16/211,946

(22) Filed: Dec. 6, 2018

(65) Prior Publication Data

US 2019/0189060 A1 Jun. 20, 2019

(30) Foreign Application Priority Data

Dec. 18, 2017 (KR) ..... 10-2017-0174431

(51) Int. Cl.

| | |
|---|---|
| ***G09G 5/00*** | (2006.01) |
| ***G09G 3/3275*** | (2016.01) |
| ***G09G 3/3225*** | (2016.01) |
| ***G09G 3/3266*** | (2016.01) |
| ***G09G 3/3291*** | (2016.01) |
| ***G09G 3/3233*** | (2016.01) |

(52) U.S. Cl.

CPC ..... *G09G 3/3275* (2013.01); *G09G 3/3225* (2013.01); *G09G 3/3233* (2013.01); *G09G 3/3266* (2013.01); *G09G 3/3291* (2013.01); *G09G 2310/0248* (2013.01); *G09G 2310/0251* (2013.01); *G09G 2310/062* (2013.01); *G09G 2320/0252* (2013.01); *G09G 2320/0295* (2013.01)

(58) Field of Classification Search

CPC .. G09G 3/3275; G09G 3/3233; G09G 3/3291; G09G 3/3266; G09G 3/3225; G09G 2310/0248; G09G 2310/0251; G09G 2310/062; G09G 2320/0252; G09G 2320/0295

See application file for complete search history.

(56) References Cited

U.S. PATENT DOCUMENTS

2009/0140959 A1* 6/2009 Nam ..... G09G 3/3233 345/76
2010/0079361 A1* 4/2010 Lee ..... G09G 3/3233 345/77
2011/0025585 A1* 2/2011 Kim ..... G09G 3/3233 345/76

(Continued)

*Primary Examiner* — Adam J Snyder
(74) *Attorney, Agent, or Firm* — Seed Intellectual Property Law Group LLP

(57) ABSTRACT

An organic light emitting display (OLED) device comprises: a display panel including a substrate, a plurality of data lines on the substrate, a plurality of gate lines on the substrate and oriented transverse to the data lines, and a plurality of pixels connected to the data lines and the gate lines. A data driver supplies data voltages to the data lines, and a gate-in-panel (GIP) gate driver supplies gate pulses to the gate lines. The gate driver drives the display panel in a plurality of blocks of pixel lines within one frame. The data voltages are sequentially supplied to pixel lines of a jth block (j is a natural number) during a data writing period, and a black image is written simultaneously to pixel lines of a qth block (q is a natural number different from j) during a black data insertion period.

19 Claims, 32 Drawing Sheets

(56) References Cited

U.S. PATENT DOCUMENTS

| | | | | |
|---|---|---|---|---|
| 2014/0022289 | A1* | 1/2014 | Lee | G09G 3/006<br>345/691 |
| 2014/0044228 | A1* | 2/2014 | Jang | G11C 19/00<br>377/64 |
| 2015/0187267 | A1* | 7/2015 | Park | G09G 3/3233<br>345/77 |
| 2015/0187268 | A1* | 7/2015 | Tani | G09G 3/3233<br>345/77 |
| 2016/0078834 | A1* | 3/2016 | Hong | G11C 19/287<br>345/212 |
| 2016/0086544 | A1* | 3/2016 | Park | G09G 3/3233<br>345/690 |
| 2019/0043424 | A1* | 2/2019 | Wang | G09G 3/3241 |

* cited by examiner

FIG. 10

| Line | CRCLK | SC/SECLK |
|---|---|---|
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 10 | 10 | 10 |
| 11 | 11 | 11 |
| 12 | 12 | 12 |
| 13 | 13 | 13 |
| 14 | 14 | 14 |
| 15 | 15 | 15 |
| 16 | 16 | 16 |
| 17 | 1 | 1 |
| 18 | 2 | 2 |
| 19 | 3 | 3 |
| 20 | 4 | 4 |
| 21 | 5 | 5 |
| 22 | 6 | 6 |
| 23 | 7 | 7 |
| 24 | 8 | 8 |
| 25 | 9 | 9 |
| 26 | 10 | 10 |
| 27 | 11 | 11 |
| 28 | 12 | 12 |
| 29 | 13 | 13 |
| 30 | 14 | 14 |
| 31 | 15 | 15 |
| 32 | 16 | 16 |

Low-order CLKs

High-order CLKs

Repeating units

| Line | CRCLK | SC/SECLK |
|---|---|---|
| 1081 | 9 | 9 |
| 1082 | 10 | 10 |
| 1083 | 11 | 11 |
| 1084 | 12 | 12 |
| 1085 | 13 | 13 |
| 1086 | 14 | 14 |
| 1087 | 15 | 15 |
| 1088 | 16 | 16 |
| 1089 | 1 | 1 |
| 1090 | 2 | 2 |
| 1091 | 3 | 3 |
| 1092 | 4 | 4 |
| 1093 | 5 | 5 |
| 1094 | 6 | 6 |
| 1095 | 7 | 7 |
| 1096 | 8 | 8 |
| 1097 | 9 | 9 |
| 1098 | 10 | 10 |
| 1099 | 11 | 11 |
| 1100 | 12 | 12 |
| 1101 | 13 | 13 |
| 1102 | 14 | 14 |
| 1103 | 15 | 15 |
| 1104 | 16 | 16 |
| 1105 | 1 | 1 |
| 1106 | 2 | 2 |
| 1107 | 3 | 3 |
| 1108 | 4 | 4 |
| 1109 | 5 | 5 |
| 1100 | 6 | 6 |
| 1111 | 7 | 7 |
| 1112 | 8 | 8 |

Low-order CLKs

High-order CLKs

FIG. 13

| Line | CRCLK | SC/SECLK | |
|---|---|---|---|
| 1 | 1 | 1 | Low-order CLKs |
| 2 | 2 | 2 | |
| 3 | 3 | 3 | |
| 4 | 4 | 4 | |
| 5 | 5 | 5 | |
| 6 | 6 | 6 | |
| 7 | 7 | 7 | |
| 8 | 8 | 8 | |
| 9 | 1 | 1 | |
| 10 | 2 | 2 | |
| 11 | 3 | 3 | |
| 12 | 4 | 4 | |
| 13 | 5 | 5 | |
| 14 | 6 | 6 | |
| 15 | 7 | 7 | |
| 16 | 8 | 8 | |
| 17 | 9 | 9 | High-order CLKs |
| 18 | 10 | 10 | |
| 19 | 11 | 11 | |
| 20 | 12 | 12 | |
| 21 | 13 | 13 | |
| 22 | 14 | 14 | |
| 23 | 15 | 15 | |
| 24 | 16 | 16 | |
| 25 | 9 | 9 | |
| 26 | 10 | 10 | |
| 27 | 11 | 11 | |
| 28 | 12 | 12 | |
| 29 | 13 | 13 | |
| 30 | 14 | 14 | |
| 31 | 15 | 15 | |
| 32 | 16 | 16 | |

Repeating units

| Line | CRCLK | SC/SECLK | |
|---|---|---|---|
| 1073 | 9 | 9 | Low-order CLKs |
| 1074 | 10 | 10 | |
| 1075 | 11 | 11 | |
| 1076 | 12 | 12 | |
| 1077 | 13 | 13 | |
| 1078 | 14 | 14 | |
| 1079 | 15 | 15 | |
| 1080 | 16 | 16 | |
| 1081 | 9 | 9 | |
| 1082 | 10 | 10 | |
| 1083 | 11 | 11 | |
| 1084 | 12 | 12 | |
| 1085 | 13 | 13 | |
| 1086 | 14 | 14 | |
| 1087 | 15 | 15 | |
| 1088 | 16 | 16 | |
| 1089 | 1 | 1 | High-order CLKs |
| 1090 | 2 | 2 | |
| 1091 | 3 | 3 | |
| 1092 | 4 | 4 | |
| 1093 | 5 | 5 | |
| 1094 | 6 | 6 | |
| 1095 | 7 | 7 | |
| 1096 | 8 | 8 | |
| 1097 | 1 | 1 | |
| 1098 | 2 | 2 | |
| 1099 | 3 | 3 | |
| 1100 | 4 | 4 | |
| 1101 | 5 | 5 | |
| 1102 | 6 | 6 | |
| 1103 | 7 | 7 | |
| 1104 | 8 | 8 | |

FIG. 16

| Line | CRCLK | SC/SECLK | |
|---|---|---|---|
| 1 | 1 | 1 | Low-order CLKs / Repeating units |
| 2 | 2 | 2 | |
| 3 | 3 | 3 | |
| 4 | 4 | 4 | |
| 5 | 5 | 5 | |
| 6 | 6 | 6 | |
| 7 | 7 | 1 | |
| 8 | 8 | 2 | |
| 9 | 1 | 3 | |
| 10 | 2 | 4 | |
| 11 | 3 | 5 | |
| 12 | 4 | 6 | |
| 13 | 5 | 1 | |
| 14 | 6 | 2 | |
| 15 | 7 | 3 | |
| 16 | 8 | 4 | |
| 17 | 1 | 5 | |
| 18 | 2 | 6 | |
| 19 | 3 | 1 | |
| 20 | 4 | 2 | |
| 21 | 5 | 3 | |
| 22 | 6 | 4 | |
| 23 | 7 | 5 | |
| 24 | 8 | 6 | |
| 25 | 9 | 7 | High-order CLKs |
| 26 | 10 | 8 | |
| 27 | 11 | 9 | |
| 28 | 12 | 10 | |
| 29 | 13 | 11 | |
| 30 | 14 | 12 | |
| 31 | 15 | 7 | |
| 32 | 16 | 8 | |
| 33 | 9 | 9 | |
| 34 | 10 | 10 | |
| 35 | 11 | 11 | |
| 36 | 12 | 12 | |
| 37 | 13 | 7 | |
| 38 | 14 | 8 | |
| 39 | 15 | 9 | |
| 40 | 16 | 10 | |
| 41 | 9 | 11 | |
| 42 | 10 | 12 | |
| 43 | 11 | 7 | |
| 44 | 12 | 8 | |
| 45 | 13 | 9 | |
| 46 | 14 | 10 | |
| 47 | 15 | 11 | |
| 48 | 16 | 12 | |

| Line | CRCLK | SC/SECLK | |
|---|---|---|---|
| 1081 | 9 | 7 | Low-order CLKs |
| 1082 | 10 | 8 | |
| 1083 | 11 | 9 | |
| 1084 | 12 | 10 | |
| 1085 | 13 | 11 | |
| 1086 | 14 | 12 | |
| 1087 | 15 | 7 | |
| 1088 | 16 | 8 | |
| 1089 | 9 | 9 | |
| 1090 | 10 | 10 | |
| 1091 | 11 | 11 | |
| 1092 | 12 | 12 | |
| 1093 | 13 | 7 | |
| 1094 | 14 | 8 | |
| 1095 | 15 | 9 | |
| 1096 | 16 | 10 | |
| 1097 | 9 | 11 | |
| 1098 | 10 | 12 | |
| 1099 | 11 | 7 | |
| 1100 | 12 | 8 | |
| 1101 | 13 | 9 | |
| 1102 | 14 | 10 | |
| 1103 | 15 | 11 | |
| 1104 | 16 | 12 | |
| 1105 | 1 | 1 | High-order CLKs |
| 1106 | 2 | 2 | |
| 1107 | 3 | 3 | |
| 1108 | 4 | 4 | |
| 1109 | 5 | 5 | |
| 1110 | 6 | 6 | |
| 1111 | 7 | 1 | |
| 1112 | 8 | 2 | |
| 1113 | 1 | 3 | |
| 1114 | 2 | 4 | |
| 1115 | 3 | 5 | |
| 1116 | 4 | 6 | |
| 1117 | 5 | 1 | |
| 1118 | 6 | 2 | |
| 1119 | 7 | 3 | |
| 1120 | 8 | 4 | |
| 1121 | 1 | 5 | |
| 1122 | 2 | 6 | |
| 1123 | 3 | 1 | |
| 1124 | 4 | 2 | |
| 1125 | 5 | 3 | |
| 1126 | 6 | 4 | |
| 1127 | 7 | 5 | |
| 1128 | 8 | 6 | |

FIG. 20

| Line | CRCLK | SC/SECLK |
|---|---|---|
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 1 | 1 |
| 8 | 2 | 2 |
| 9 | 3 | 3 |
| 10 | 4 | 4 |
| 11 | 5 | 5 |
| 12 | 6 | 6 |
| 13 | 1 | 1 |
| 14 | 2 | 2 |
| 15 | 3 | 3 |
| 16 | 4 | 4 |
| 17 | 5 | 5 |
| 18 | 6 | 6 |
| 19 | 1 | 1 |
| 20 | 2 | 2 |
| 21 | 3 | 3 |
| 22 | 4 | 4 |
| 23 | 5 | 5 |
| 24 | 6 | 6 |
| 25 | 7 | 7 |
| 26 | 8 | 8 |
| 27 | 9 | 9 |
| 28 | 10 | 10 |
| 29 | 11 | 11 |
| 30 | 12 | 12 |
| 31 | 7 | 7 |
| 32 | 8 | 8 |
| 33 | 9 | 9 |
| 34 | 10 | 10 |
| 35 | 11 | 11 |
| 36 | 12 | 12 |
| 37 | 7 | 7 |
| 38 | 8 | 8 |
| 39 | 9 | 9 |
| 40 | 10 | 10 |
| 41 | 11 | 11 |
| 42 | 12 | 12 |
| 43 | 7 | 7 |
| 44 | 8 | 8 |
| 45 | 9 | 9 |
| 46 | 10 | 10 |
| 47 | 11 | 11 |
| 48 | 12 | 12 |

Low-order CLKs

High-order CLKs

Repeating units

| Line | CRCLK | SC/SECLK |
|---|---|---|
| 1081 | 7 | 7 |
| 1082 | 8 | 8 |
| 1083 | 9 | 9 |
| 1084 | 10 | 10 |
| 1085 | 11 | 11 |
| 1086 | 12 | 12 |
| 1087 | 7 | 7 |
| 1088 | 8 | 8 |
| 1089 | 9 | 9 |
| 1090 | 10 | 10 |
| 1091 | 11 | 11 |
| 1092 | 12 | 12 |
| 1093 | 7 | 7 |
| 1094 | 8 | 8 |
| 1095 | 9 | 9 |
| 1096 | 10 | 10 |
| 1097 | 11 | 11 |
| 1098 | 12 | 12 |
| 1099 | 7 | 7 |
| 1100 | 8 | 8 |
| 1101 | 9 | 9 |
| 1102 | 10 | 10 |
| 1103 | 11 | 11 |
| 1104 | 12 | 12 |
| 1105 | 1 | 1 |
| 1106 | 2 | 2 |
| 1107 | 3 | 3 |
| 1108 | 4 | 4 |
| 1109 | 5 | 5 |
| 1110 | 6 | 6 |
| 1111 | 1 | 1 |
| 1112 | 2 | 2 |
| 1113 | 3 | 3 |
| 1114 | 4 | 4 |
| 1115 | 5 | 5 |
| 1116 | 6 | 6 |
| 1117 | 1 | 1 |
| 1118 | 2 | 2 |
| 1119 | 3 | 3 |
| 1120 | 4 | 4 |
| 1121 | 5 | 5 |
| 1122 | 6 | 6 |
| 1123 | 1 | 1 |
| 1124 | 2 | 2 |
| 1125 | 3 | 3 |
| 1126 | 4 | 4 |
| 1127 | 5 | 5 |
| 1128 | 6 | 6 |

Low-order CLKs

High-order CLKs

Scheme 1

Scheme 1 Foward

Scheme 2 Reverse

Scheme 2

Scheme 3

GATE-IN-PANEL GATE DRIVER AND ORGANIC LIGHT EMITTING DISPLAY DEVICE HAVING THE SAME

This application claims the priority benefit of Korean Patent Application No. 10-2017-0174431 filed on Dec. 18, 2017, which is hereby incorporated herein by reference for all purposes as if fully set forth herein.

BACKGROUND

Technical Field

The present disclosure relates to an active-matrix display panel and a display device comprising the same.

Description of the Related Art

Flat-panel displays (FPDs) are widely used for monitors for desktop computers, portable computers such as laptops and PDAs, mobile phones, and so on, because they offer advantages in terms of slimness and lightweightness. Such flat-panel displays include liquid-crystal displays (LCDs), plasma display panels (PDPs), field emission displays (FEDs), and organic light-emitting diode displays (OLEDs).

Meanwhile, black image insertion techniques have been proposed to reduce the motion picture response time (MPRT) of a display device. That is, this technology aims to eliminate an image from a previous frame by displaying a black image in between each video frame. However, the conventional black image display techniques should double the video frame rate, which results in a lack of data charging time.

BRIEF SUMMARY

An exemplary embodiment of the present disclosure provides an organic light emitting display (OLED) device that includes: a display panel including a substrate, a plurality of data lines on the substrate, a plurality of gate lines on the substrate and oriented transverse to the data lines, and a plurality of pixels connected to the data lines and the gate lines. A data driver supplies data voltages to the data lines, and a gate-in-panel (GIP) gate driver supplies gate pulses to the gate lines. The gate driver drives the display panel in a plurality of blocks of pixel lines within one frame, the one frame including a plurality of cycles, each of the cycles having a data writing period, at least one black data insertion period, and at least one precharge period. The data voltages are sequentially supplied to pixel lines of a jth block (j is a natural number) during the data writing period of a cycle of the plurality of cycles, and a black image is written simultaneously to pixel lines of a qth block (q is a natural number different from j) during the at least one black data insertion period of the cycle.

In another embodiment, the present disclosure provides a gate-in-panel (GIP) gate driver that includes a plurality of stages. Each of the stages includes a first pull-up transistor, a second pull-up transistor, a first Q node control transistor, and a second Q node control transistor. The first pull-up transistor receives a respective carry clock and outputs carry signals corresponding to the carry clock in response to a Q node voltage of the stage. The second pull-up transistor receives a respective scan clock and outputs scan signals corresponding to the scan clock in response to the Q node voltage. The first Q node control transistor charges the Q node in response to a forward carry signal in a forward scan mode. The second Q node control transistor discharges the Q node in response to a reverse carry signal in the forward scan mode. Each of the carry clocks includes an image clock signal for generating a respective one of the scan signals that are output during a data writing period, and a black data insertion (BDI) clock signal for generating a respective one of the scan signals that are output during a black data insertion period.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIGS. 10 and 11 are views showing how the clocks and the stages are connected according to the first exemplary embodiment;

FIGS. 13 and 14 are views showing how the clocks and the stages are connected according to the second exemplary embodiment;

FIGS. 16 to 18 are views showing how the clocks and the stages are connected according to the third exemplary embodiment;

FIGS. 20 and 21 are views showing how the clocks and the stages are connected according to the fourth exemplary embodiment;

DETAILED DESCRIPTION

Figure 1:
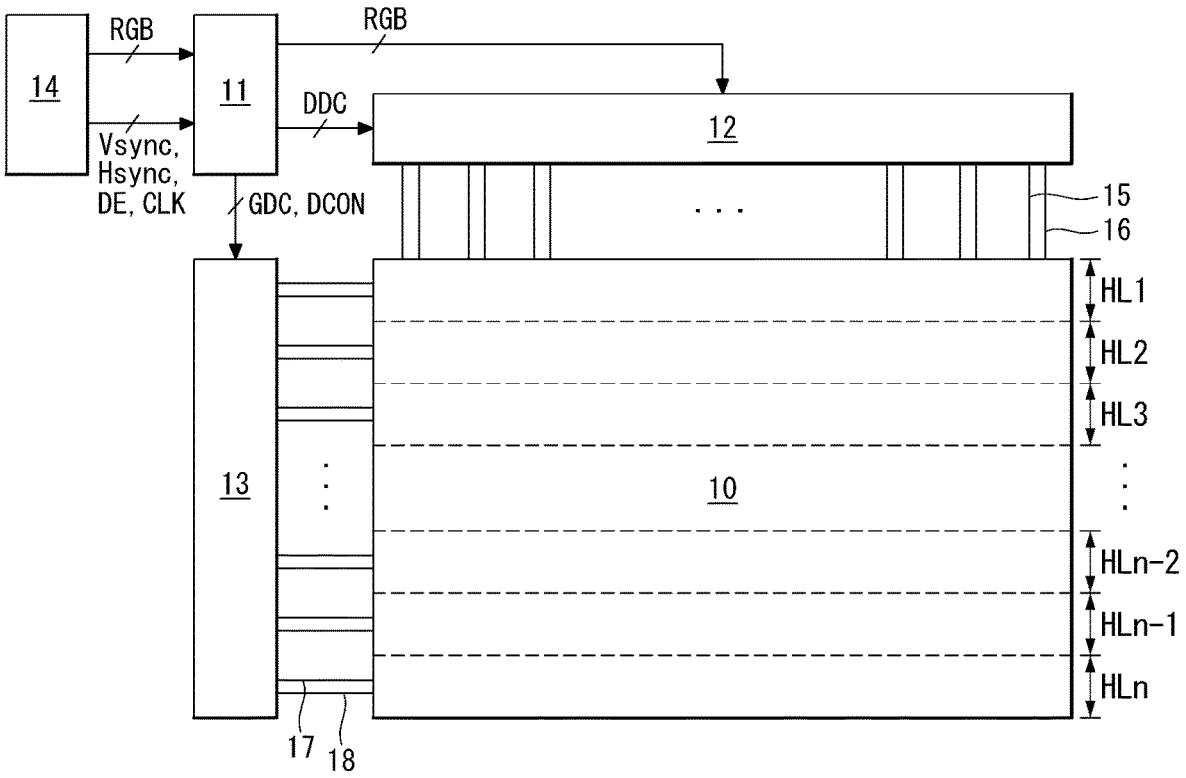
FIG. 1 is a view showing an organic light-emitting diode display according to the present disclosure.

Advantages and features of the present disclosure and methods of accomplishing the same may be understood more readily by reference to the following detailed description of preferred embodiments and the accompanying drawings. The present disclosure may, however, be embodied in many different forms and should not be construed as being limited to the embodiments set forth herein. Rather, these embodiments are provided so that this disclosure will be thorough and complete and will fully convey the concept of the disclosure to those skilled in the art, and the present disclosure will only be defined by the appended claims.

Hereinafter, exemplary embodiments of the present disclosure will be described in detail with reference to the accompanying drawings. Throughout the specification, the same reference numerals indicate substantially the same components. In describing the present disclosure, when it is deemed that a detailed description of known functions or configurations may unnecessarily obscure the subject matter of the present disclosure, the detailed description will be omitted.

Although the embodiments of the present disclosure disclose transistors of a pixel that are all implemented as N-type, the technical idea of the present disclosure is not limited thereto and may be applicable to P-type transistors.

While this specification here is described with respect to an organic light-emitting display device, the technical idea of the present disclosure is not limited to the organic light-emitting display device. For example, the pixels on the display panel shown in FIG. 1 may be composed of liquid crystal cells shown in FIG. 2B, and the configuration of FIG. 1 may be varied for the liquid-crystal display device.

FIG. 1 is a view showing a display device according to an exemplary embodiment of the present disclosure.

As shown in FIG. 1, the display device according to the exemplary embodiment of the present disclosure comprises a display panel 10, a timing controller 11, a data driver 12, and a gate driver 13.

A plurality of data lines 15 and reference voltage lines 16 and a plurality of gate lines 17 and 18 are formed on a display portion of the display panel 10. Pixels are formed at the regions of intersections of the data lines 15, reference voltage lines 16, and gate lines 17 and 18. For example, each pixel may be connected to a data line 15, a reference voltage line 16, and gate lines 17 and 18. The term "intersect" is used herein in its broadest sense to include within the meaning that one element crosses over or overlaps another element, and does not necessarily require that the two elements contact each other. For example, the data lines 15 and reference voltage lines 16, which extend in a first direction, may overlap with the gate line units 17, 18, which extend in a second direction transverse to the first direction, and thus intersect with each other, but may be physically separated from one another, for example, by one or more layers or elements provided there between. It also includes within its meaning, in some embodiments, that the lines or elements can contact each other. The pixels may be separated horizontally line by line. For example, the pixels may be divided into first to nth pixel lines HL1 to HLn. The pixels arranged in the same horizontal orientation receive the same scan signal.

The gate lines 17 and 18 comprise first gate lines 17 to which scan signals are applied and second gate lines 18 to which sensing signals are applied. Each pixel may be connected to one of the data lines 15, one of the reference voltage lines 16, one of the first gate lines 17, and one of the second gate lines 18. Each pixel comprises an OLED and a driving transistor, and can operate in duty-cycle mode to control the light emission duty cycle of the OLED.

Such a pixel receives a high-potential driving voltage EVDD and a low-potential driving voltage EVSS. The thin film transistors (TFTs) constituting the pixel may be implemented as P-type or N-type, or a hybrid of the two. Semiconductor layers of the TFTs constituting the pixel may include any suitable material, and in some embodiments may comprise amorphous silicon, polysilicon, or oxide.

The data driver 12 converts input image data RGB into a data voltage and supplies this data voltage to the data lines 15, under control of the timing controller 11. Also, the data driver 12 generates a reference voltage and supplies it to the reference voltage lines 16, under control of the timing controller 11.

Under control of the timing controller 11, the gate driver 13 generate a scan signal synchronized with the data voltage and supplies it to the first gate lines 17 and generates a sensing signal synchronized with the reference voltage and supplies it to the second gate lines 18.

The scan signal generated for duty cycle operation during one frame comprises first and second scan signals, and the gate driver 13 supplies the first scan signal and the second scan signal to the same pixel separately during one frame. The first scan signal and the second scan signal are supplied with a time difference between them.

The sensing signal generated for duty cycle operation during one frame is composed only of a first sensing pulse, and the first sensing pulse may be supplied to the pixel, in synchronization with the first scan signal. The sensing signal generated for duty cycle operation during one frame may be composed only of a first sensing pulse and a second sensing pulse, and the gate driver 13 may supply the first sensing pulse to the pixel in synchronization with the first scan signal and then supply the second sensing pulse to the pixel after the second sensing pulse.

The gate driver 13 may comprise a level shifter and a shift register. The level shifter is formed on a printed circuit board (not shown) connected to the display panel 10 in the form of an integrated circuit (IC). The level shifter level-shifts a start signal, a carry clock CRCLK, a scan clock SCCLK, a sense clock SECLK, etc., and then supplies them to the shift register. The shift register comprises a plurality of stages connected in cascade. The level shifter outputs two or more start signals in one frame and supplies them to the shift register. In some embodiments, the gate driver 13 may be a gate-in-panel (GIP) gate driver which is embedded in a non-active area of the display panel 10. For example, the GIP gate driver 13 may be mounted directly on a substrate of the display panel 10.

The timing controller 11 receives input image data RGB from a host system 14 via an interface circuit (not shown)

and supplies this image data RGB to the data driver 12 through various interface methods such as a mini-LVDS.

The timing controller 11 receives timing signals, such as a vertical synchronization signal Vsync, a horizontal synchronization signal Hsync, a data enable signal DE, and a dot clock signal DCLK, from the host system 14 and generates control signals for controlling the operation timings of the data driver 12 and gate driver 13. The control signals comprise a gate timing control signal GDC for controlling the operation timing of the gate driver 13, a source timing control signal DDC for controlling the operation timing of the data driver 12, and a duty control signal DCON for controlling the light emission duty cycle of the OLED.

Figure 2:
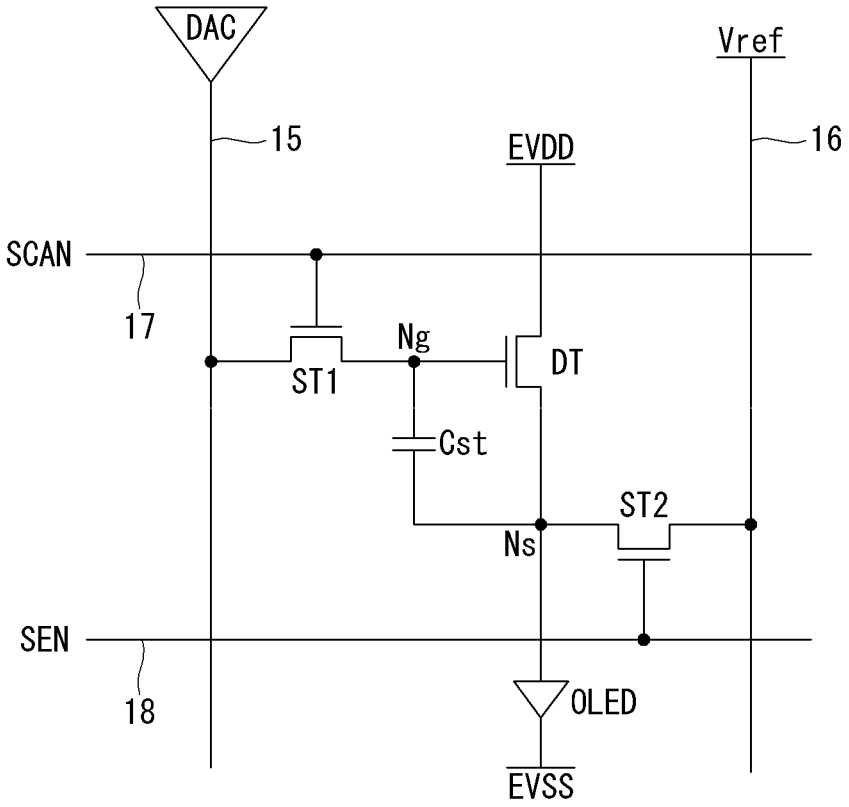
FIG. 2 is equivalent circuit diagram of a pixel shown in FIG. 1 according to an exemplary embodiment.

FIG. 2 is a view showing an example of pixel. FIG. 2 depicts a pixel comprising an organic light-emitting diode.

Referring to FIG. 2, a pixel according to the present disclosure comprises an OLED, a driving thin-film transistor DT, a storage capacitor Cst, a first switching TFT ST1, and a second switching TFT ST2.

The OLED comprises an anode connected to a source node Ns, a cathode connected to an input terminal of the low-potential driving voltage EVSS, and an organic compound layer situated between the anode and the cathode.

The driving transistor DT controls the drive current flowing through the OLED depending on the voltage difference between a gate node Ng and a source node Ns. The driving transistor DT has a gate electrode connected to the gate node Ng, a drain electrode connected to an input terminal of the high-potential driving voltage EVDD, and a source electrode connected to the source node Ns. The storage capacitor Cst is connected between the gate node Ng and the source node Ns.

The first switching TFT ST1 applies a data voltage on a data line 15 to the gate node Ng by switching the current flow between the data line 15 and the gate node Ng in response to a scan signal SCAN. The first switching TFT ST1 has a gate electrode connected to a first gate line 17, a drain electrode connected to the data line 15, and a source electrode connected to the gate node Ng.

The second switching TFT ST2 applies a reference voltage Vref on the reference voltage line 16 to the source node Ns by switching the current flow between the reference voltage line 16 and the source node Ns in response to a sense signal SEN. The second switching TFT ST2 has a gate electrode connected to a second gate line 18, a drain electrode connected to the reference voltage line 16, and a source electrode connected to the source node Ns.

The display panel 10 of the display device shown in FIG. 1 may be implemented by a liquid-crystal display device comprising a liquid crystal cell. On a lower substrate of the display panel implemented into a liquid-crystal display device are data lines, gate lines, TFTs, pixel electrodes connected to the TFTs, and storage capacitors connected to the pixel electrodes. Each pixel adjusts the amount of light transmission by using liquid crystal molecules driven by the voltage difference between the pixel electrode which stores data voltage through the TFT and a common electrode to which common voltage Vcom is applied.

Figure 3:
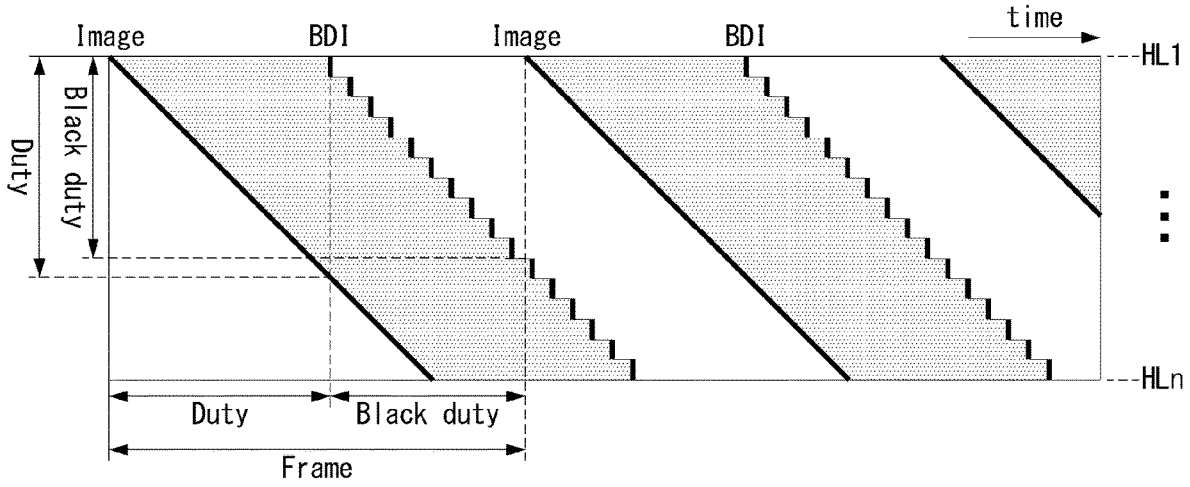
FIG. 3 is a view showing the duty cycle of an organic light-emitting diode display device according to the present disclosure.
Figure 4:
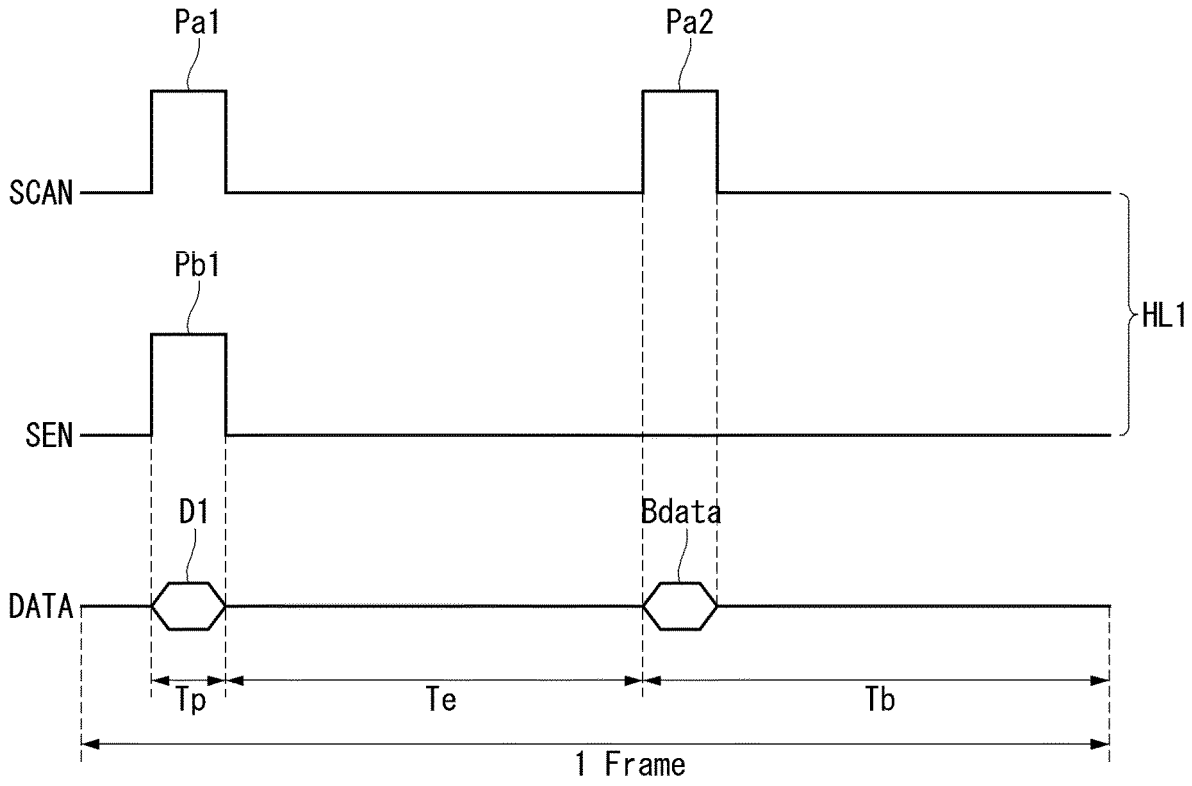
FIG. 4 is a timing diagram showing the duty cycle of an organic light-emitting diode display device according to the present disclosure.

FIGS. 3 and 4 are views for explaining the duty cycle of an organic light-emitting display device according to the present disclosure.

Referring to FIGS. 3 and 4, in the organic light-emitting display device according to the present disclosure, both image data and black data are written within one frame period. That is, the organic light-emitting display device according to the present disclosure may use a black data insertion technology without increasing the frame rate.

FIG. 4 shows driving waveforms of a scan signal SCAN, sense signal SEN, and data voltage DATA that are applied to a first pixel on a first pixel line HL1. That is, one frame for duty-cycle operation comprises a programming period Tp in which the voltage between the gate node Ng and the source node Ns is set in response to a drive current, a light-emission period Te in which the OLED emits light in response to a drive current, and a non-light-emission period Tb in which the OLED does not emit light. The light emission duty may correspond to the light emission period Te and the black duty may correspond to the black period Tb. As shown in FIG. 4, the scan signal includes an image scan signal Pa1 synchronized with the timing of writing image data, and a BDI scan signal Pa2 for black data insertion (BDI) synchronized with the timing of writing black data.

Figure 5A:
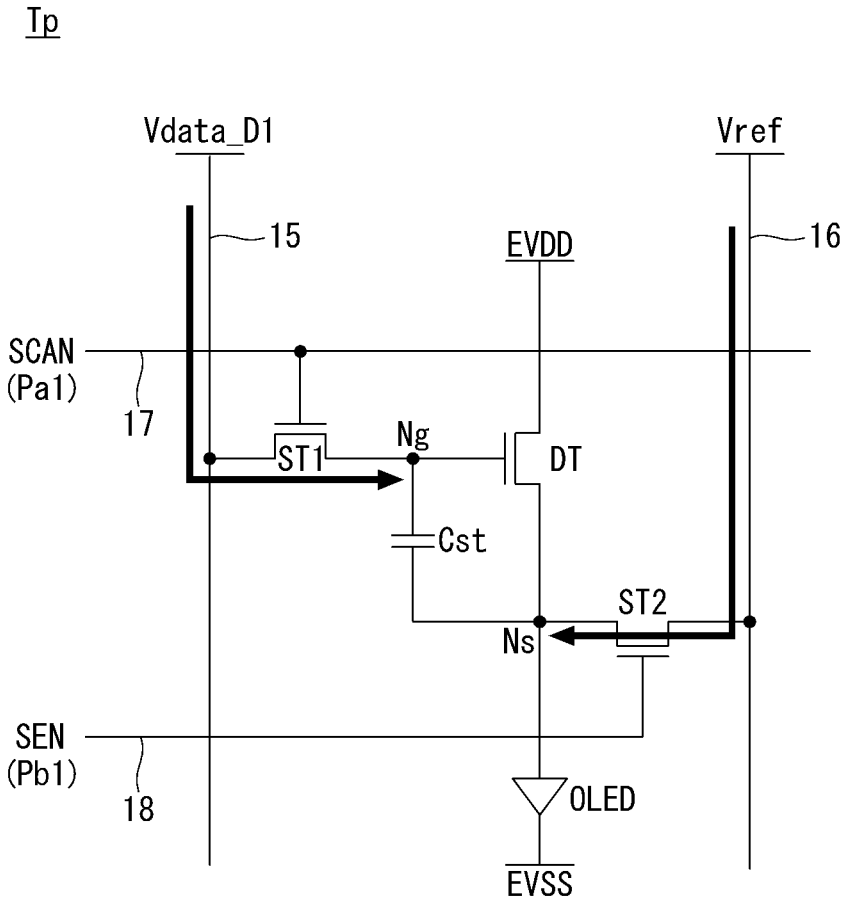
FIG. 5A is an equivalent circuit diagram of a pixel in a programing period of FIG. 8.
Figure 5B:
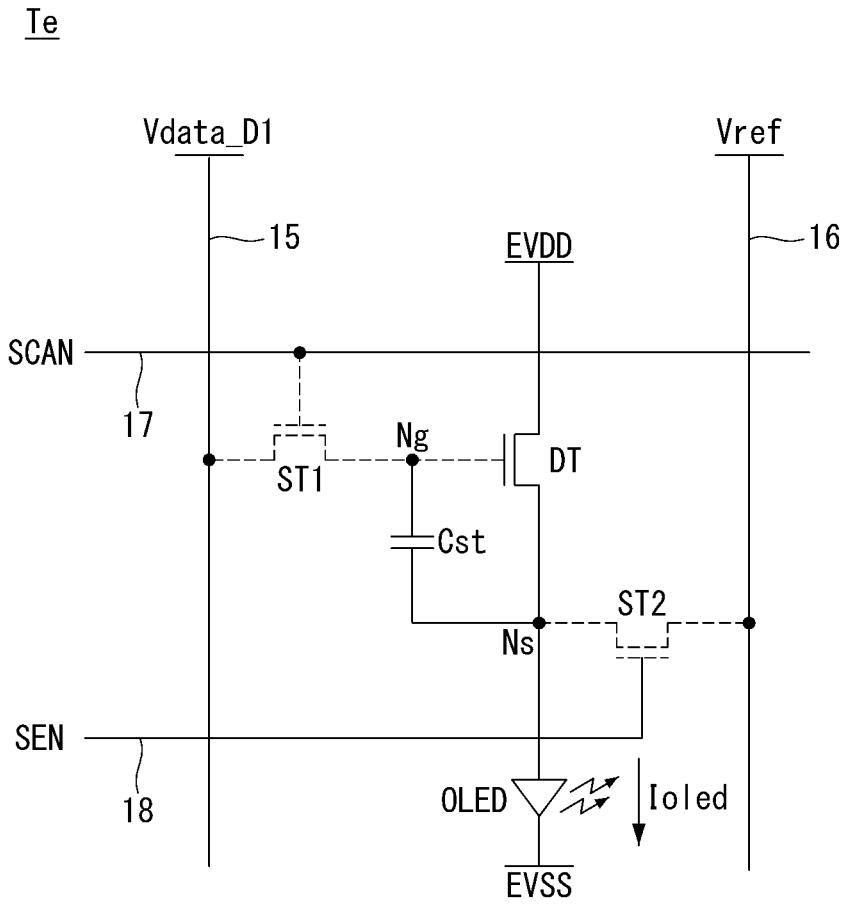
FIG. 5B is an equivalent circuit diagram of a pixel in a light-emission period of FIG. 8.
Figure 5C:
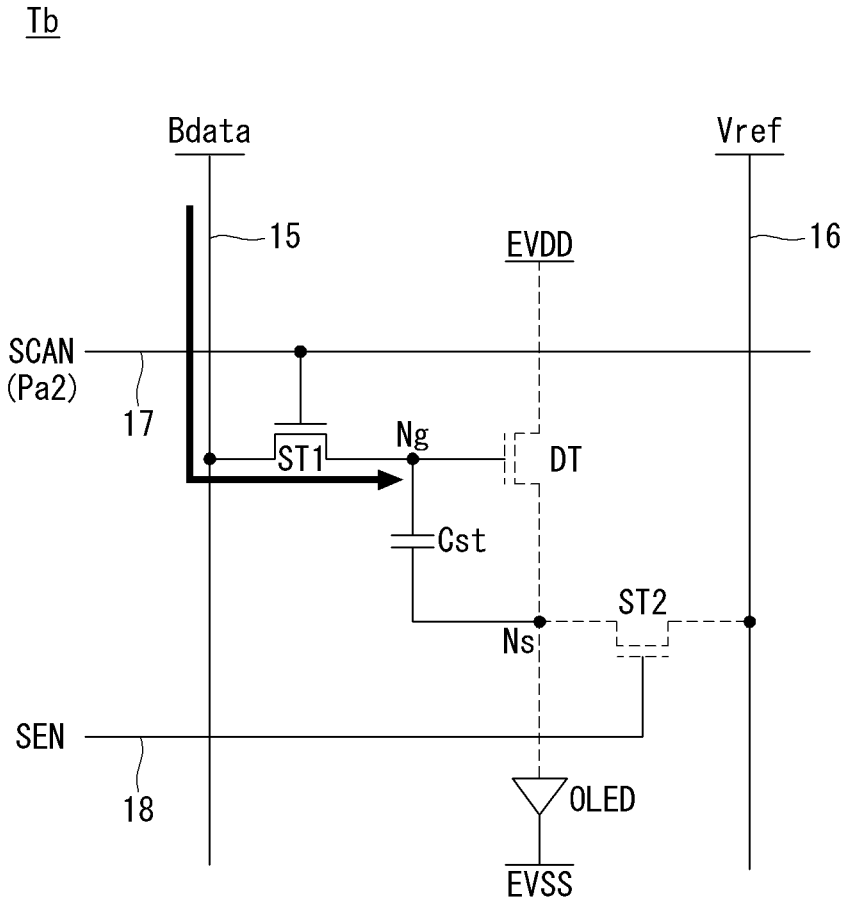
FIG. 5C is an equivalent circuit diagram of a pixel in a non-light-emission period of FIG. 8.

FIGS. 5A to 5C are views showing how a pixel operates during the programming period, the light-emission period, and the non-light-emission period, respectively.

As shown in FIG. 5A, in the programming period Tp, the first switching TFT ST1 of the first pixel is turned on in response to an image scan signal Pa1 of a scan signal SCAN to apply a first data voltage D1 to the gate node Ng. In the programing period Tp, the second switching TFT ST2 of the first pixel is turned on in response to a first sensing pulse Pb1 of a sensing signal SEN to apply a reference voltage Vref to the source node Ns. Through this, the voltage between the gate node Ng and source node Ns of the first pixel is set according to a drive current.

As shown in FIG. 5B, in the light-emission period Te, the first switching TFT ST1 of the first pixel is turned off in response to the scan signal SCAN, and the second switching TFT ST2 of the first pixel is turned off in response to the sense signal SEN. The voltage Vgs between the gate node Ng and the source node Ns, which is preset for the first pixel in the programming period Tp, is held in the light-emission period Te. In this case, the voltage Vgs between the gate node Ng and the source node Ns is higher than a threshold voltage Vth of the driving transistor DT of the first pixel. Thus, a drive current flows through the driving transistor of the first pixel during the light-emission period Te. With this drive current, the potential of the gate node Ng and the potential of the source node are boosted while the voltage Vgs between the gate node Ng and the source node Ns is maintained in the light-emission period Te. When the potential of the source node Ns is boosted to an operating point level of the OLED, the OLED of the first pixel emits light.

As shown in FIG. 5C, in the non-light-emission period Tb, the first switching TFT ST1 of the first pixel is turned on in response to a BDI scan pulse Pa2 of the scan signal SCAN to apply a black data voltage Bdata to the gate node Ng. The second switching TFT ST2 of the first pixel remains turned off in response to the sensing signal SEN. Here, the black data voltage Bdata is a data voltage for displaying a black image.

During the light-emission period Te, the scan signal SCAN and the sense signal SEN are sequentially applied to pixel lines, and the pixel lines are sequentially supplied with data voltage.

At a point in time when the non-light-emission period Tb starts, a plurality of BDI scan pulses Pa2 are simultaneously turned on, and therefore a plurality of pixel lines simultaneously receive black data voltage Bdata.

An image scan pulse Pa1 for writing an image data voltage is output at an image clock timing, and a BDI scan pulse Pa2 for writing a black data voltage Bdata is output at a BDI clock timing.

Figure 6:
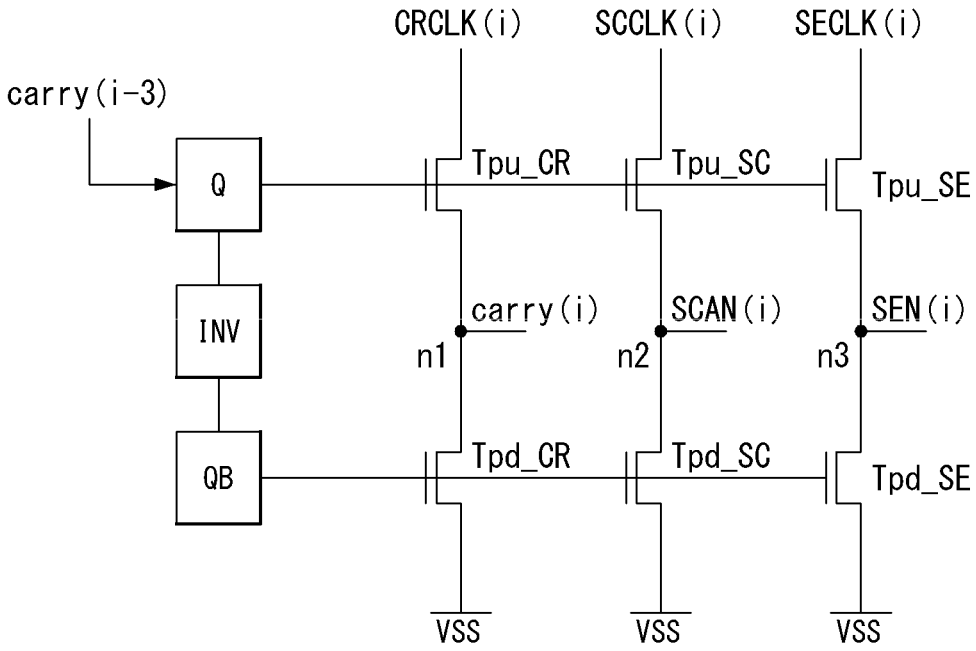
FIG. 6 is a schematic diagram of stages of a gate driver according to the present disclosure.

FIG. 6 is a schematic diagram of stages of the gate driver according to the present disclosure.

Referring to FIG. 6, an ith stage (i is a natural number) of the shift register comprises first to third pull-up transistors Tpu_CR, Tpu_SC, and Tpu_SE that output clocks according to the voltage of a Q node. The ith stage STG1 is a stage that outputs a scan signal SCAN and a sense signal SEN to drive an ith pixel line HL1.

The Q node is charged by receiving a start signal or preceding carry signal carry[i−3] or discharged by receiving a reset signal or a succeeding carry signal carry[i+3]. The carry signals received by the ith stage are not limited to i±3 but may vary depending on the design.

The first pull-up transistor Tpu_CR comprises a gate electrode connected to the Q node, a drain electrode to which a carry clock CRCLK is applied, and a source electrode connected to a first output terminal n1. When the Q node is charged, the first pull-up transistor Tpu_CR outputs a carry signal carry[i] to the first output terminal n1 by using the carry clock CRCLK applied to the drain electrode.

The second pull-up transistor Tpu_SC comprises a gate electrode connected to the Q node, a drain electrode to which a scan clock SCCLK is applied, and a source electrode connected to a second output terminal n2. When the Q node is charged, the second pull-up transistor Tpu_SC outputs a scan signal SCAN[i] to the second output terminal n2 by using the scan clock SCCLK applied to the drain electrode.

The third pull-up transistor Tpu_SE comprises a gate electrode connected to the Q node, a drain electrode to which a sense clock SECLK is applied, and a source electrode connected to a third output terminal n3. When the Q node is charged, the third pull-up transistor Tpu_SE outputs a sense signal SEN[i] to the third output terminal n3 by using the sense clock SECLK applied to the drain electrode.

The first pull-down transistor Tpd_CR comprises a gate electrode connected to a QB node, a drain electrode connected to an input terminal of the low-potential voltage VSS, and a source electrode connected to the first output terminal n1. The first pull-down transistor Tpd_CR discharges the first output terminal n1 to the low-potential voltage VSS, in response to a QB node voltage.

The second pull-down transistor Tpd_SC comprises a gate electrode connected to the QB node, a drain electrode connected to the input terminal of the low-potential voltage VSS, and a source electrode connected to the second output terminal n2. The second pull-down transistor Tpd_SC discharges the second output terminal n2 to the low-potential voltage VSS, in response to the QB node voltage.

The third pull-down transistor Tpd_SE comprises a gate electrode connected to the QB node, a drain electrode connected to the input terminal of the low-potential voltage VSS, and a source electrode connected to the third output terminal n3. The third pull-down transistor Tpd_SE discharges the third output terminal n3 to the low-potential voltage VSS, in response to the QB node voltage.

An inverter INV controls the voltages of the Q node and the QB node in opposite ways.

The gate driver according to the present disclosure drives zk pixel lines during one cycle within one frame period. One cycle comprises an image data writing period, a black data insertion period, and a precharge period. A period in which image data is written to one pixel line may be defined as 1 horizontal period 1H, and the black data insertion period BDI and the precharge period each may correspond to 1 horizontal period 1H. The black data insertion period BDI is repeated k times within one cycle. The precharge period Pre comes after the black data insertion period BDI. The precharge period Pre is a period following the black data insertion period BDI, in which the gate nodes of the pixels connected to the next pixel line are precharged.

In other words, in one cycle according to the present disclosure, (z+2) horizontal periods are repeated k times, which comprise an image data writing period corresponding to z horizontal periods (z≥2), a black data insertion period corresponding to 1 horizontal period, and a precharge period corresponding to 1 horizontal period.

First Exemplary Embodiment

The gate driver according to the first exemplary embodiment drives 16 pixel lines during one cycle.

That is, an image data writing period lasts for 8 horizontal periods within a 1/2 cycle, then a black data writing period lasts for 1 horizontal period, and then a precharge period lasts for 1 horizontal period. In this way, 10 horizontal periods for driving 8 pixel lines are repeated once more, and as a result, the gate driver according to the first exemplary embodiment drives 16 pixel lines during one cycle of 20 horizontal periods.

Figure 7:
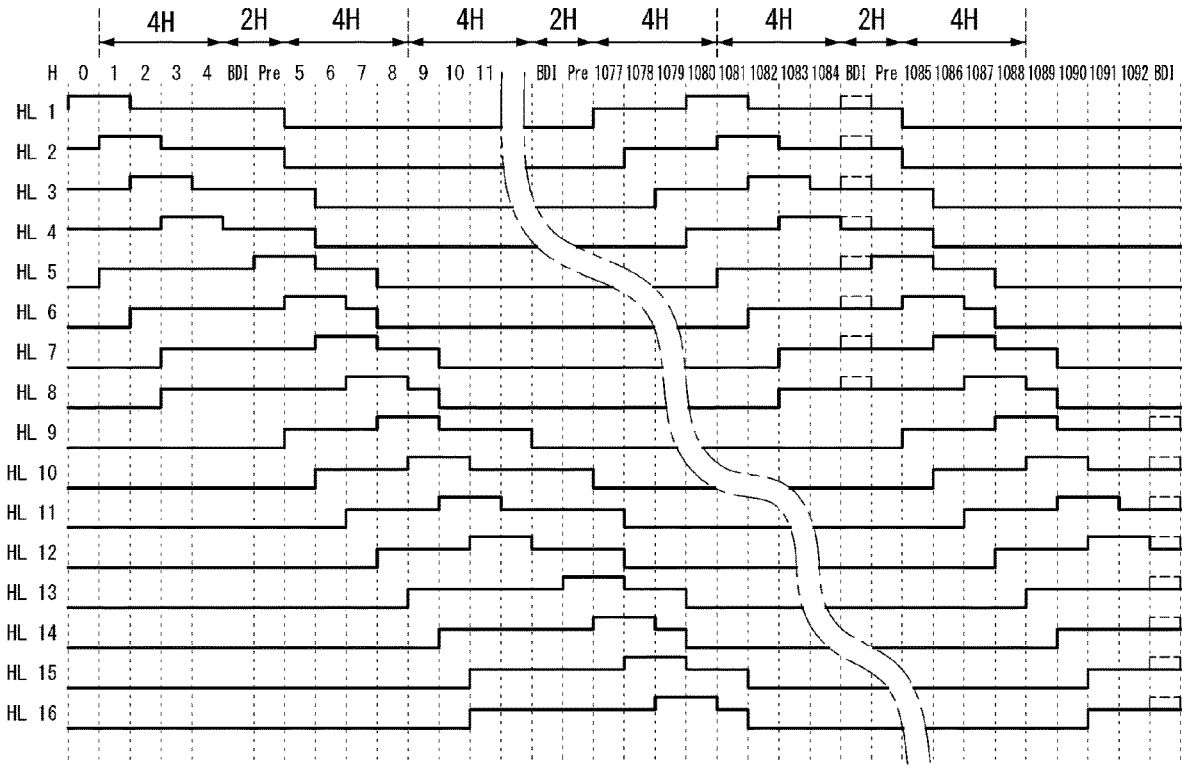
FIGS. 7 and 8 are views showing voltage variation of stages connected to pixel lines relative to the operation of the gate driver according to a first exemplary embodiment.
Figure 8:
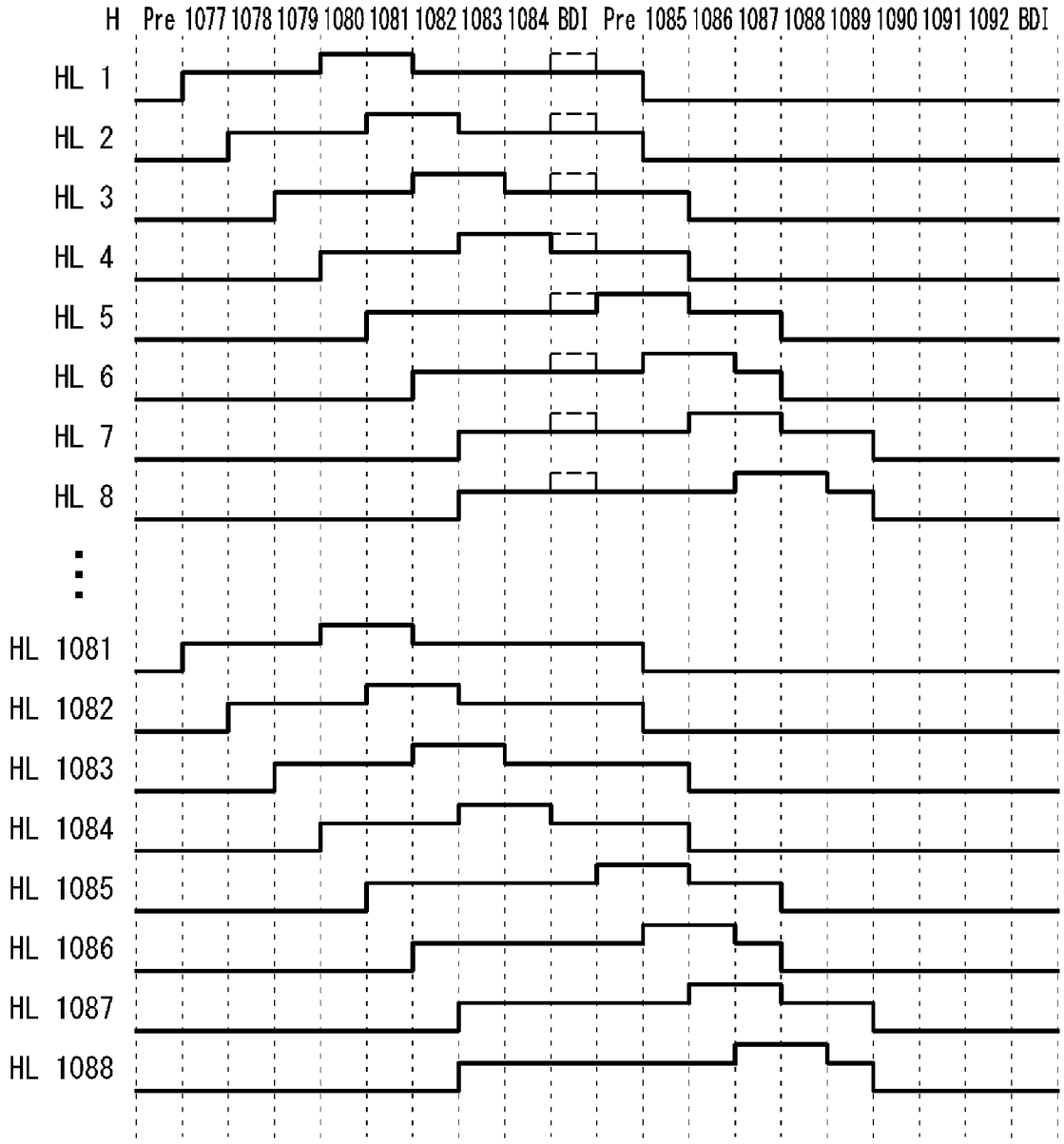
Figure 9:
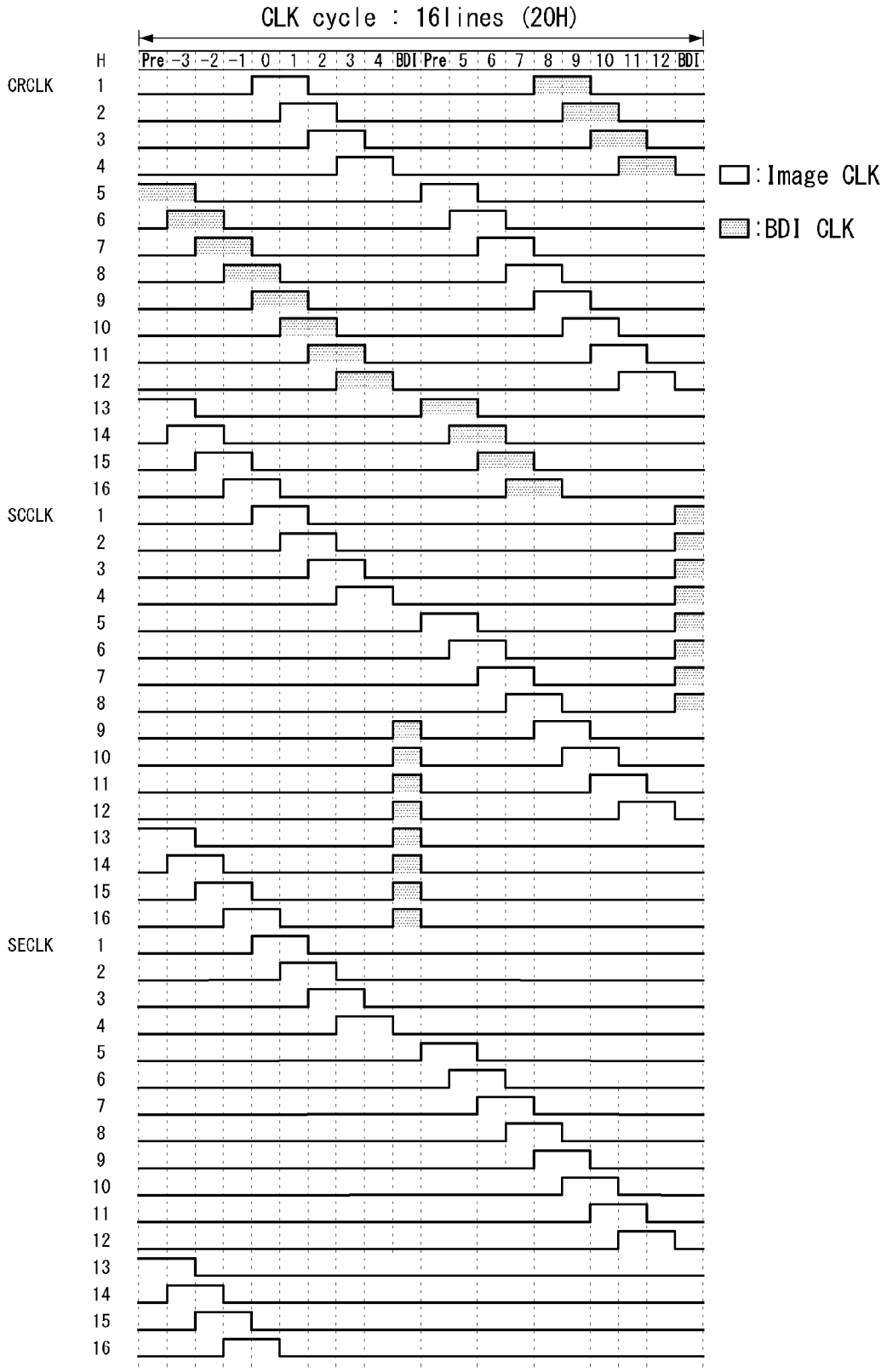
FIG. 9 is a view showing timings of clocks according to the first exemplary embodiment.
Figure 11:
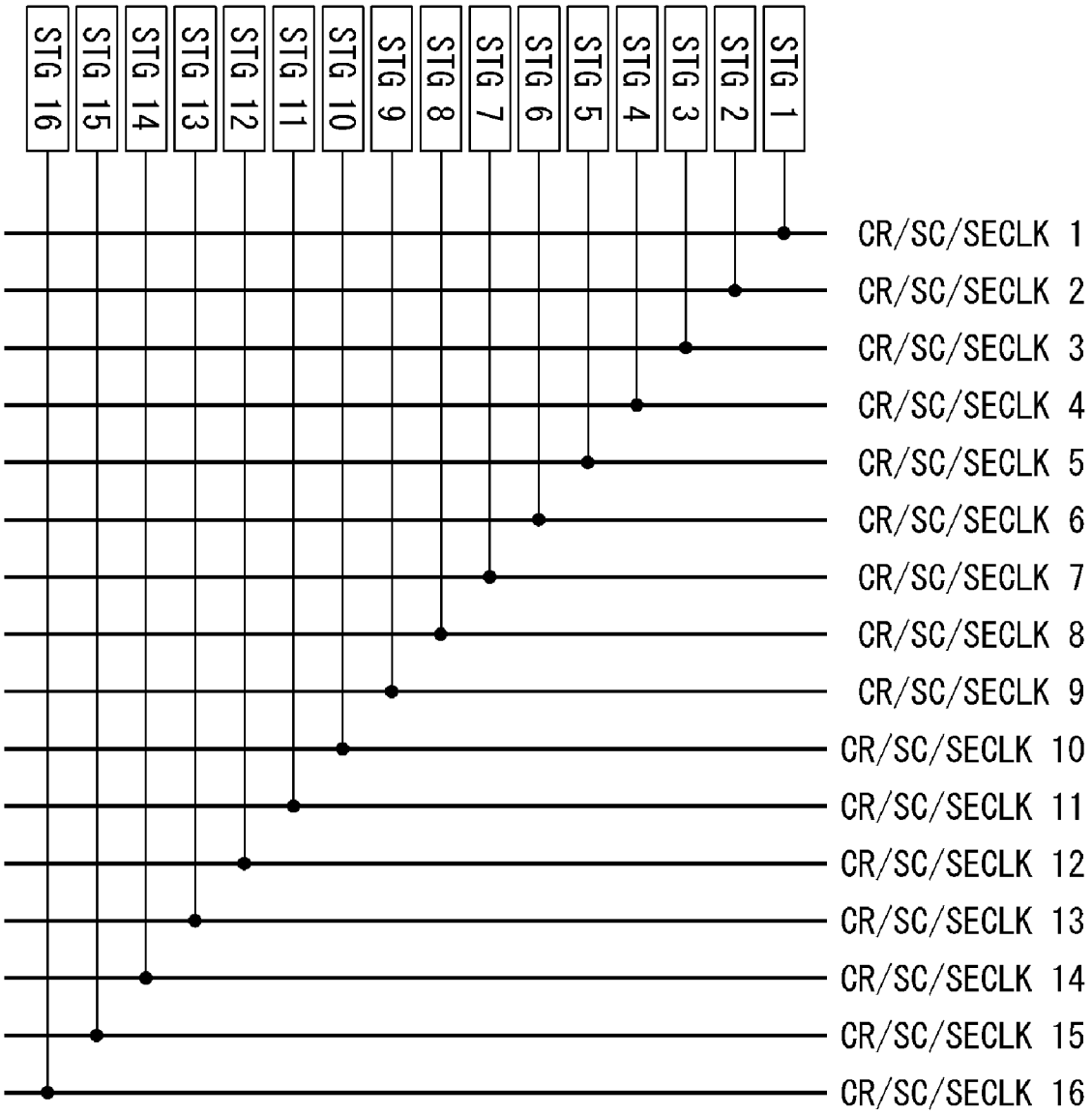

FIGS. 7 and 8 are views showing Q node voltage variation of stages in the gate driver according to the first exemplary embodiment. FIG. 9 is a view showing carry clocks, scan clocks, and sense clocks according to the first exemplary embodiment. FIGS. 10 and 11 are views showing how the stages and the carry clocks, scan clocks, and sense clocks are connected. Of the horizontal periods shown in FIGS. 7 to 9, the periods indicated by numbers (e.g., 0, 1, 2, etc.) denote image data writing periods, BDI denotes black data insertion periods, and Pre denotes precharge periods. Hereinafter, an ith horizontal period refers to an image data writing period in which image data is written to an (i+16j)th pixel line (j is an integer greater than or equal to 0; 0<i+16j≤total number of pixel lines). A signal for turning on or off the Q node corresponds to a stage that outputs a carry signal at a corresponding timing. That is, a signal for turning on the Q node of a fifth stage is a carry signal outputted by a first stage, and a signal for turning off the Q node of the fifth stage is a carry signal outputted by a ninth stage.

The scan clocks shown in FIG. 9 determine the timing of a scan signal, and the sense clocks shown in FIG. 9 determine the timing of a sense signal. That is, when the scan clocks have a turn-on voltage, the stages output a scan signal, and when the sense clocks have the turn-on voltage, the stages output a sense signal.

As a result, the gate driver according to the first exemplary embodiment sequentially outputs a scan signal and a sense signal during an image data writing period corresponding to 8 horizontal periods. Then, the gate driver supplies a scan signal simultaneously to a plurality of pixel lines during a black data writing period. Also, the gate driver outputs a scan signal and a sense signal during a precharge period.

As shown in FIG. 9, the carry clocks CRCLK, scan clocks SCCLK, and sense clocks SECLK each have 16 phases. The carry clocks CRCLK, scan clocks SCCLK, and sense clocks SECLK each have one cycle of 20 horizontal periods. One cycle is a period in which 16 pixel lines are driven.

The turn-on voltage of the carry clocks CRCLK, scan clocks SCCLK, and sense clocks SECLK is maintained during 2 horizontal periods 2H, and then a turn-off voltage is maintained during 8 horizontal periods 8H. The turn-on voltage of the first to 16th carry clocks CRCLK1 to CRCLK16 may be divided for an image writing clock and a black data writing clock. The image writing clock and the black data writing clock alternate with each other. That is, the image writing clock is inverted to the turn-off voltage, and the black data writing clock has the turn-off voltage after 8 horizontal periods.

The first to 16th carry clocks CRCLK1 to CRCLK16 are sequentially outputted during the image data writing period while maintaining the turn-on voltage during 2 horizontal periods. The ninth to 16th scan clocks SCCLK9 to SCCLK16 maintain the turn-on voltage during a first black data insertion period, and the first to eighth scan clocks SCCLK1 to SCCLK8 maintain the turn-on voltage during a second black data insertion period.

The first to 16th carry clocks CRCLK1 to CRCLK16 are sequentially outputted during the image data writing period while maintaining the turn-on voltage during 2 horizontal periods.

Referring to FIGS. 10 and 11, the first carry clock CRCLK, the first scan clock SCCLK, and the first sense clock SECLK are connected to the first stage STG. The second carry clock CRCLK, the second scan clock SCCLK, and the second sense clock SECLK are connected to the second stage STG. Likewise, the ith (i is a natural number less than or equal to 16) carry clock CRCLK, the ith scan clock SCCLK, and the ith sense clock SECLK are connected to the ith stage STG.

In the first exemplary embodiment, the duty cycle of a light-emission period may be set to (16n+8)lines/number of frame lines. The number of frame lines is the sum of the total number of pixel lines and the number of lines corresponding to a vertical blanking interval. In this specification, the duty cycle is defined as the interval of time between each pixel line, which spans from the time when an image data writing carry clock is inputted to a certain stage until the time when a black data insertion carry clock is inputted to the stage STG.

The actual insertion of black data into pixels occurs, not at a point in time when a black data insertion carry clock is applied, but during a black data insertion period BDI in which a black data insertion scan clock is applied while the Q node of the stage STG is in a charged state. In the present disclosure, a scan signal SCAN for writing image data is sequentially outputted, and a scan signal SCAN for inserting black data is simultaneously written to a plurality of pixel lines HL during 1 horizontal period. Thus, each pixel line HL has a slightly different duty cycle for an image display period.

In the present specification, the duty cycle is defined relative to a point in time when a carry clock CRCLK for charging the Q node is inputted to a stage, rather than relative to an actual image display period.

For example, when the pixel lines displaying an image on the display panel 10 are made up of first to 2160th pixel lines HL1 to HL2160, there is no blanking interval, and n is set to 67, the duty cycle is 1080/2160 (i.e., (16*67+8)/2160). That is, when n is set to 67, a display device with 2,160 pixel lines has a 50% duty cycle according to the first exemplary embodiment. When the blanking interval corresponds to 320 lines and n is set to 67, the duty cycle is 1080/2480, that is, 43.55%.

The operation of the gate driver during 1 frame according to the first exemplary embodiment when n=67 will be described below.

While the Q node of the first stage STG is in a charged state, the first stage STG outputs the first carry signal in response to the first carry clock CRCLK during the first horizontal period 1H. Then, the first stage STG outputs the first scan signal SCAN in response to the first scan clock SCCLK, and outputs the first sense signal SEN in response to the first sense clock SECLK. As a result, data is written to the pixels on the first pixel line HL1 during the first horizontal period 1H.

Likewise, the pixels on the second pixel line HL2 are programmed during the second horizontal period 2H. Then, the pixels on the first pixel line HL1 emit light based on data programmed during the first horizontal period 1H.

In this line sequential method, data is sequentially written to the pixels arranged on the first to fourth pixel lines HL1 to HL4 during the first to fourth horizontal periods 1H to 4H.

Next, the ninth to 16th scan clocks SCCLK9 to SCCLK16 are applied at the turn-on voltage during the first black data insertion period BDI to output the ninth to sixteen scan signals. The pixel lines to which the ninth to 16th scan signals SCAN outputted during the first black data insertion period BDI are supplied may vary depending on the duty cycle.

Using the line sequential method, the first to 1072nd pixel lines HL1 to HL1072 sequentially emit light during the first to 1072nd horizontal periods 1H to 1072H. In the black data insertion period BDI which occurs on every 8 lines, corresponding to 10 horizontal periods out of the first to 1072nd horizontal periods 1H to 1072H, black data is inserted into a certain group of pixel lines comprising 8 pixel lines, out of the 1073rd to 2160th pixel lines HL1073 to HL2160 that display the preceding frame image.

The 1073rd to 1080th horizontal periods 1080H are periods in which image data is written to the 1073rd to 1080th pixel lines HL, which correspond to operating times spanning from the first horizontal period 1H until the eighth horizontal period 8H.

When n is set to 67, a carry clock for inserting black data into the first pixel line is inputted into the 1081st pixel line which has a pixel line interval of (16*67+8=1080).

The operating times in the 1081st to 1088th horizontal periods 1081H to 1088H correspond to the operating times in the 1st horizontal period 1H to 8th horizontal period 8H. After scan signals are sequentially outputted during the 1081st horizontal period 1081H to 1084th horizontal period 1084H, the first to eighth scan signals are outputted during the subsequent black data insertion period BDI, corresponding to the timings of the first to eighth scan clocks SCCLK. The pixels arranged on the first to eighth pixel lines HL1 to HL8 are supplied with black data by the first to eighth scan signals outputted during the black data insertion period BDI.

Second Exemplary Embodiment

Figure 12:
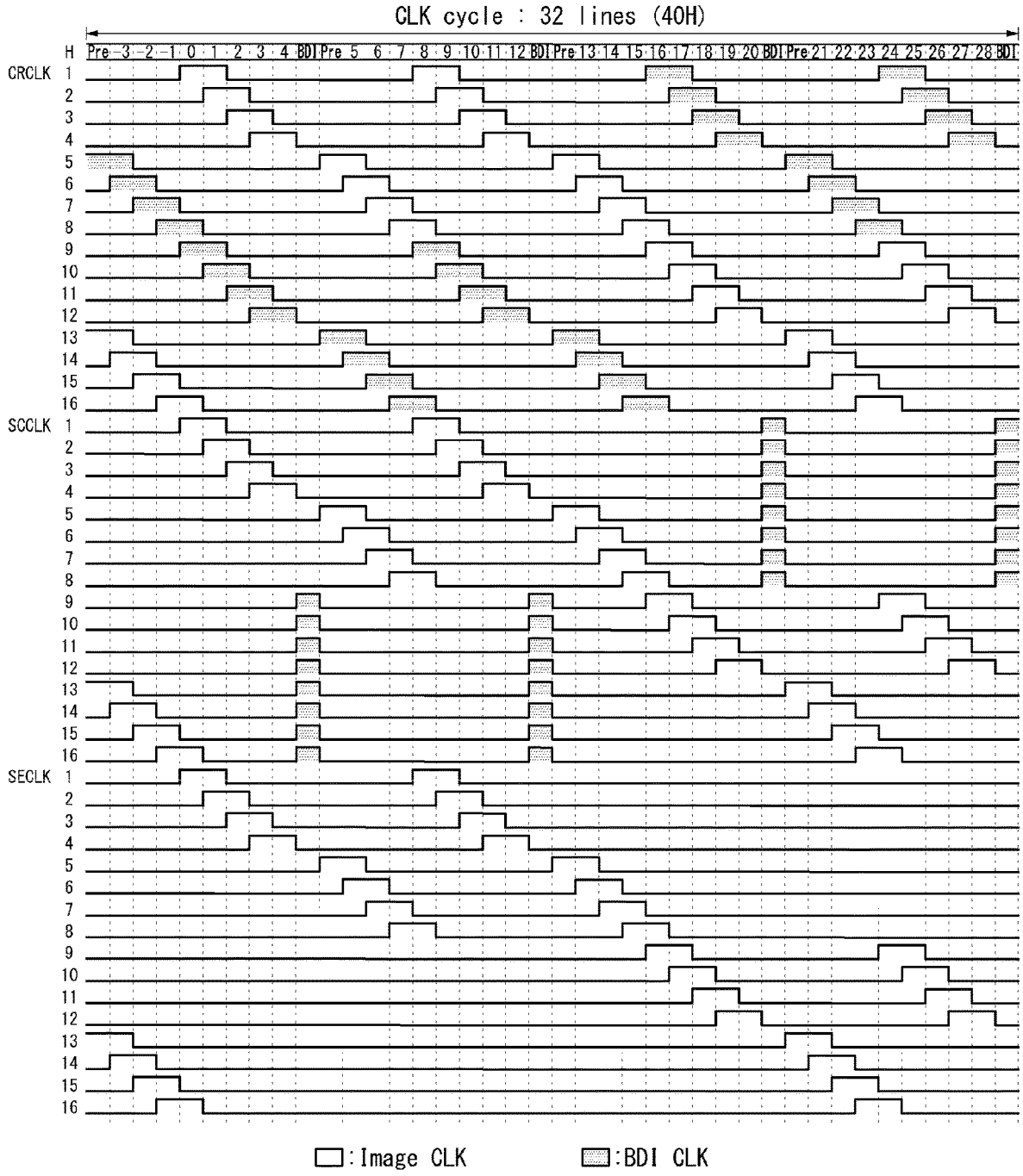
FIG. 12 is a view showing timings of clocks according to a second exemplary embodiment.
Figure 14:
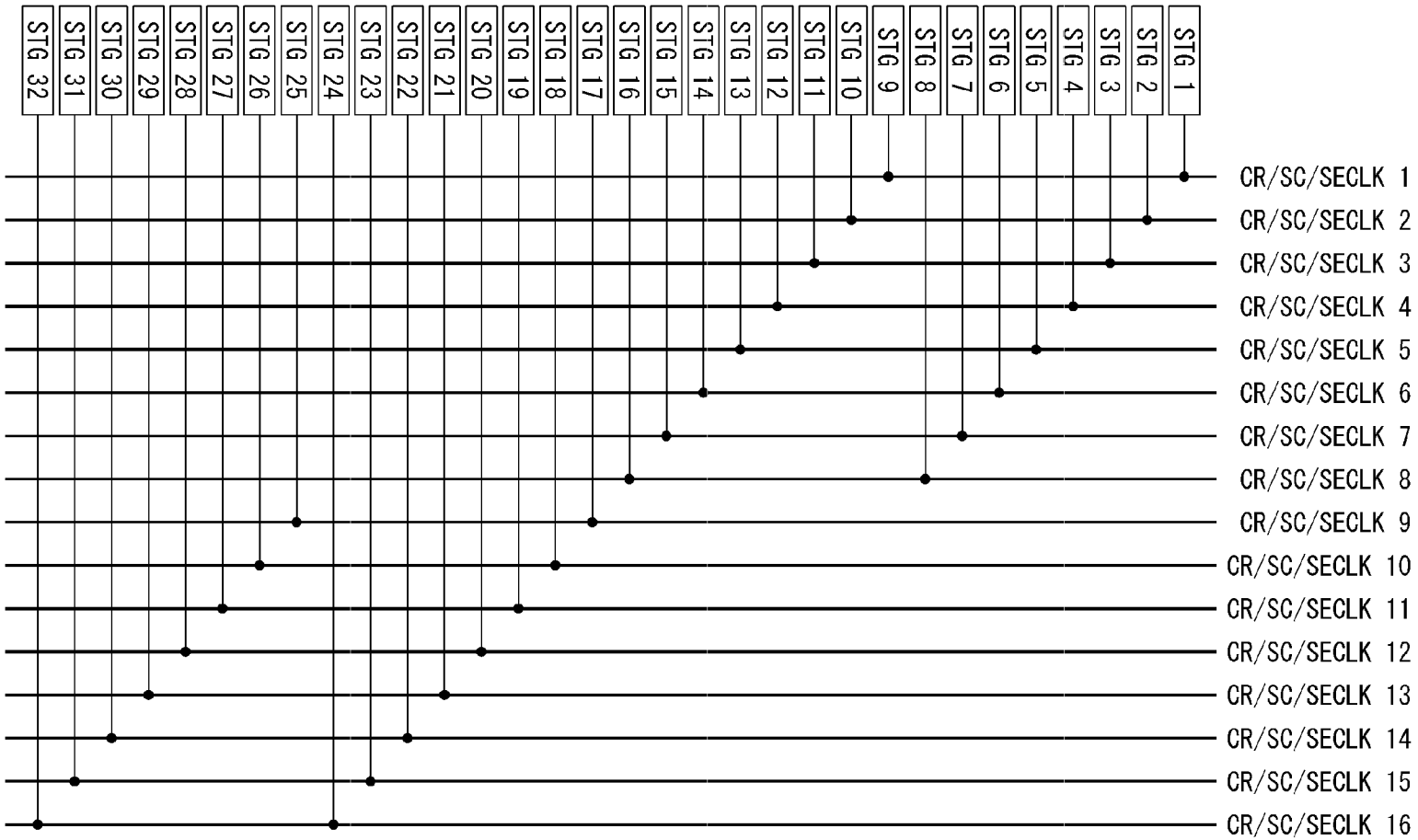

FIG. 12 is a view showing the timings of carry clocks, scan clocks, and sense clocks for driving stages according to the second exemplary embodiment. FIGS. 13 and 14 are views showing how the stages and the carry clocks, scan clocks, and sense clocks are connected. Of the horizontal periods shown in FIG. 12, the periods indicated by numbers denote image data writing periods, BDI denotes black data insertion periods, and Pre denotes precharge periods. Hereinafter, an ith horizontal period refers to an image data writing period in which image data is written to an (i+32j)th pixel line (j is an integer greater than or equal to 0, 0<i+32j≤total number of pixel lines).

As shown in FIG. 12, the carry clocks CRCLK, scan clocks SCCLK, and sense clocks SECLK each have 16 phases. The carry clocks CRCLK, scan clocks SCCLK, and sense clocks SECLK each have one cycle of 40 horizontal periods. In the second exemplary embodiment, the gate driver 13 drives 32 pixel lines during one cycle. In one cycle, the black data insertion period BDI occurs four times, and the precharge period also occurs four times.

The turn-on voltage of the first to 16th carry clocks CRCLK1 to CRCLK16 may be divided for an image clock and a BDI clock. The first to 16th carry clocks CRCLK1 to CRCLK16 maintain the turn-on voltage during 2 horizontal periods and the turn-off voltage during 8 horizontal periods.

In one cycle, the first and second applied turn-on voltages of the first to eighth carry clocks CRCLK1 to CRCLK8 correspond to image clocks, and the third and fourth applied turn-on voltages correspond to BDI clocks. In one cycle, the first and second applied turn-on voltages of the ninth to 16th carry clocks CRCLK9 to CRCLK16 correspond to BDI clocks, and the third and fourth voltages correspond to image clocks. In the present specification, the application of clocks refers to applying clocks with a turn-on voltage level. That is, the second turn-on voltage of the first carry clock refers to the turn-on voltage applied during the eighth and ninth horizontal periods 8H and 9H.

The first to 16th scan clocks SCCLK1 to SCCLK16 comprise clocks synchronized with the image clocks of the first to 16th carry clocks CRCLK1 to CRCLK16. Also, the first to eighth scan clocks SCCLK1 to SCCLK8 maintain the turn-on voltage during the third and fourth black data insertion periods BDI, and the ninth to 16th scan clocks SCCLK9 to SCCLK16 maintain the turn-on voltage during the first and second black data insertion periods BDI.

The first to 16th sense clocks SECLK1 to SECLK16 are synchronized with the image clocks of the first to 16th carry clocks CRCLK1 to CRCLK16.

Referring to FIGS. 13 and 14, the first to eighth stages STG1 to STG8 are sequentially connected to the first to eighth carry clocks CRCLK1 to CRCLK8, the first to eighth scan clocks SCCLK1 to SCCLK8, and first to eighth sense clocks SECLK1 to SECLK8. Also, the ninth to 24th stages STG9 to STG24 are sequentially connected to the first to 16th carry clocks CRCLK1 to CRCLK16, the first to 16th scan clocks SCCLK1 to SCCLK16, and first to 16th sense clocks SECLK1 to SECLK16. Subsequently, the 25th to 32nd stages STG25 to STG32 are sequentially connected to the 9th to 16th carry clocks CRCLK9 to CRCLK16, the 9th to 16th scan clocks SCCLK9 to SCCLK16, and the 9th to 16th sense clocks SECLK9 to SECLK16.

The operation of the gate driver during one cycle according to the second exemplary embodiment will be described below.

The gate driver according to the second exemplary embodiment drives 32 pixel lines during one cycle. In FIG. 12, the −3rd horizontal period −4H to 0th horizontal period 0H correspond to the preceding frame driving period. The precharge period not shown in the drawing and the 29th to 32nd horizontal periods following the precharge period have the same operating times as the −3rd horizontal period −3H to 0th horizontal period 0H.

The first to fourth stages STG1 to STG4 according to the second exemplary embodiment output first to fourth scan signals and first to fourth sense signals during the first horizontal period 1H to fourth horizontal period 4H. As a result, the first to fourth pixel lines HL1 to HL4 are sequentially supplied with data during the first to fourth horizontal periods 1H to 4H.

The gate driver 13 outputs ninth to 16th scan signals during the subsequent black data insertion period BDI.

Then, the precharge period occurs, and the fifth to eighth stages STG5 to STG8 output fifth to eighth scan signals and fifth to eighth sense signals during the fifth horizontal period 5H to eighth horizontal period 8H. As a result, the fifth to eighth pixel lines HL5 to HL8 are sequentially supplied with data during the fifth to eighth horizontal periods 5H to 8H.

Next, the ninth to 12th stages STG9 to STG12 output the first to fourth scan signals and first to fourth sense signals during the ninth horizontal period 9H to 12th horizontal period 12H. As a result, the ninth to 12th pixel lines HL9 to HL12 are sequentially supplied with data during the ninth to 12th horizontal periods 9H to 12H.

The ninth to 16th scan signals are simultaneously outputted during the black data insertion period BDI following the 12th horizontal period 12H.

Then, the precharge period occurs, and the 13th to 20th stages STG13 to STG20 output 13th to 20th scan signals and 13th to 20th sense signals (e.g., the scan and sense signals of the 5th to 12th scan clocks SCCLK5 to SCCLK12 and sense clocks SECLK5 to SECLK12, as shown in FIGS. 12 and 13) during the 13th horizontal period 13H to 20th horizontal period 20H. As a result, the 13th to 20th pixel lines HL13 to HL20 are sequentially supplied with data.

The gate driver 13 outputs the first to ninth scan signals during the black data insertion period BDI following the 20th horizontal period 20H.

Then, a 21st scan signal and a 21st sense signal (e.g., the scan and sense signals of the 13th scan clock SCCLK13 and 13th sense clock SECLK13, as shown in FIGS. 12 and 13) are outputted during the precharge period.

The 21st to 24th stages STG21 to STG24 output 21st to 24th scan signals and 21st to 24th sense signals (e.g., the scan and sense signals of the 13th to 16th scan clocks SCCLK13 to SCCLK16 and sense clocks SECLK13 to SECLK16, as shown in FIGS. 12 and 13) during the 21st horizontal period 21H to 24th horizontal period 24H. As a result, the 21st to 24th pixel lines are supplied with data.

The 25th to 28th stages STG25 to STG28 output 25th to 28th scan signals and 25th to 28th sense signals (e.g., the scan and sense signals of the 9th to 12th scan clocks SCCLK9 to SCCLK12 and sense clocks SECLK9 to SECLK12, as shown in FIGS. 12 and 13) during the 25th horizontal period 25H to 28th horizontal period 28H. As a result, the 25th to 28th pixel lines are supplied with data.

In the second exemplary embodiment, the duty cycle of a light-emission period may be set to (32n+16)lines/number of frame lines.

For example, when the pixel lines displaying an image on the display panel 10 are made up of first to 2160th pixel lines HL1 to HL2160 and n is set to 33, the duty cycle is 1072/2160. That is, when n is set to 33, a display device with 2,160 pixel lines has a 49.63% duty cycle according to the second exemplary embodiment. That is, when n is set to 33, black data is written to the first to eighth pixel lines during the black data insertion period BDI which comes immediately after 1072 horizontal lines.

Third Exemplary Embodiment

Figure 15:
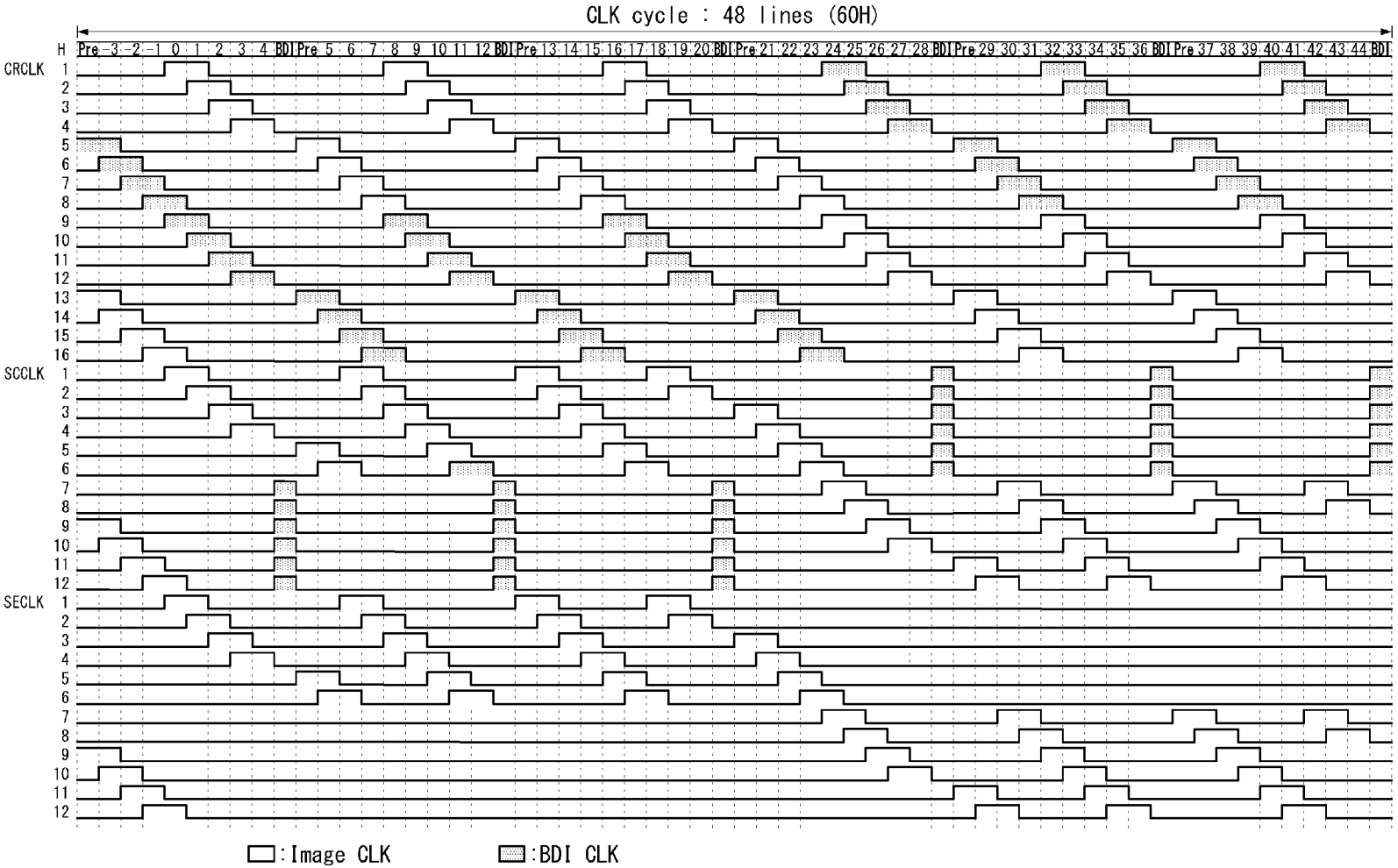
FIG. 15 is a view showing timings of clocks according to a third exemplary embodiment.
Figure 17:
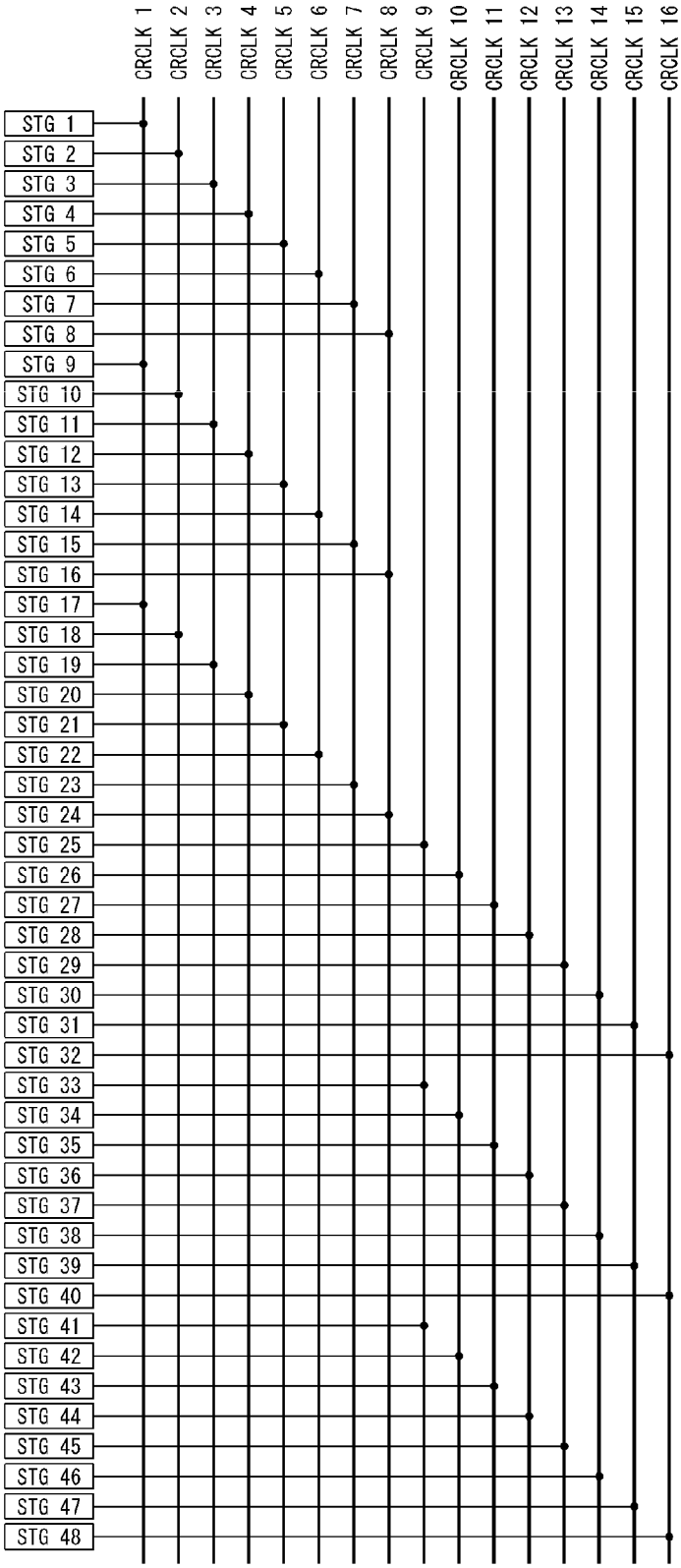
Figure 18:
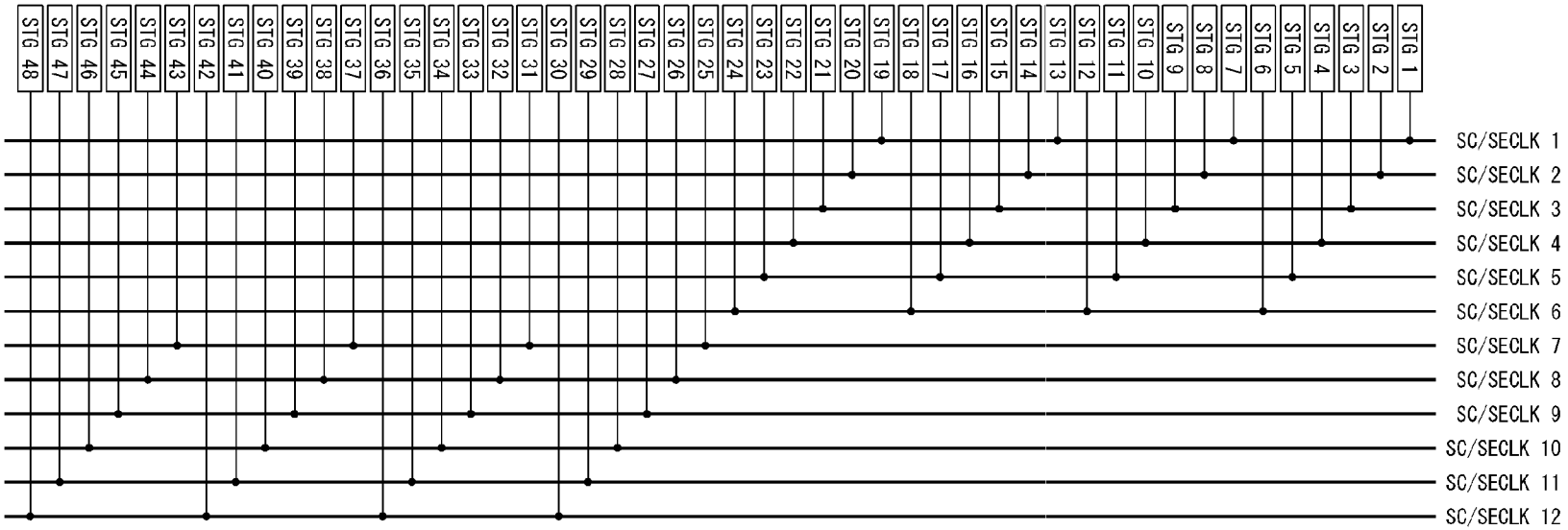

FIG. 15 is a view showing the timings of carry clocks, scan clocks, and sense clocks according to the third exemplary embodiment. FIGS. 16 to 18 are views showing how the stages and the carry clocks, scan clocks, and sense clocks are connected.

As shown in FIG. 15, the carry clocks CRCLK have 16 phases, and the scan clocks SCCLK and the sense clocks SECLK each have 12 phases. The carry clocks CRCLK, scan clocks SCCLK, and sense clocks SECLK have one cycle of 60 horizontal periods. In the third exemplary embodiment, the gate driver 13 drives 48 pixel lines during one cycle. In one cycle, the black data insertion period BDI occurs six times, and the precharge period also occurs six times.

The turn-on voltage of the first to 16th carry clocks CRCLK1 to CRCLK16 may be divided for an image clock and a BDI clock. The first to 16th carry clocks CRCLK1 to CRCLK16 maintain the turn-on voltage during 2 horizontal periods and the turn-off voltage during 8 horizontal periods.

In one cycle, the first to third turn-on voltages of the first to eighth carry clocks CRCLK1 to CRCLK8 correspond to image clocks, and the fourth to sixth turn-on voltages correspond to BDI clocks. In one cycle, the first to third turn-on voltages of the ninth to 16th carry clocks CRCLK9 to CRCLK16 correspond to BDI clocks, and the fourth to sixth turn-on voltages correspond to image clocks.

The first to sixth scan clocks SCCLK1 to SCCLK6 are sequentially outputted a total of four times during first to 24th horizontal periods 1H to 24H. The seventh to 12th scan clocks SCCLK7 to SCCLK12 are sequentially outputted a total of four times during 25th to 48th horizontal periods 25H to 48H. Also, the first to sixth scan clocks SCCLK1 to SCCLK6 maintain the turn-on voltage during the fourth to sixth black data insertion periods BDI, and the seventh to 12th scan clocks SCCLK7 to SCCLK12 maintain the turn-on voltage during the first to third black data insertion periods BDI.

The first to 12th sense clocks SECLK1 to SECLK12 are synchronized with the image clocks of the first to 12th scan clocks SCCLK1 to SCCLK12.

Referring to FIGS. 16 and 17, the first to eighth stages STG1 to STG8 are sequentially connected to the first to eighth carry clocks CRCLK1 to CRCLK8, and the ninth to 16th stages STG9 to STG16 are sequentially connected to the first to eighth carry clocks CRCLK1 to CRCLK8. The 17th to 32nd stages STG17 to STG32 are sequentially connected to the first to 16th carry clocks CRCLK1 to CRCLK16. The 33rd to 40th stages STG33 to STG40 are sequentially connected to the ninth to 16th carry clocks CRCLK9 to CRCLK16, and the 41st to 48th stages STG41 to STG48 are sequentially connected to the ninth to 16th carry clocks CRCLK9 to CRCLK16.

Referring to FIGS. 16 to 18, the first to sixth stages STG1 to STG6 are sequentially connected to the first to sixth scan clocks SCCLK1 to SCCLK6 and sequentially connected to the first to sixth sense clocks SECLK1 to SECLK6. Also, the seventh to 12th stages STG7 to STG12 are sequentially connected to the first to sixth scan clocks SCCLK1 to SCCLK6 and sequentially connected to the first to sixth sense clocks SECLK1 to SECLK6. The 13th to 18th stages STG13 to STG18 are sequentially connected to the first to sixth scan clocks SCCLK1 to SCCLK6 and sequentially connected to the first to sixth sense clocks SECLK1 to SECLK6. The 19th to 30th stages STG19 to STG30 are sequentially connected to the first to 12th scan clocks SCCLK1 to SCCLK12 and sequentially connected to the first to 12th sense clocks SECLK1 to SECLK12. The 31st to 36th stages STG31 to STG36 are sequentially connected to the seventh to 12th scan clocks SCCLK1 to SCCLK12 and sequentially connected to the seventh to 12th sense clocks SECLK7 to SECLK12. The 37th to 42nd stages STG37 to STG42 are sequentially connected to the seventh to 12th scan clocks SCCLK7 to SCCLK12 and sequentially connected to the seventh to 12th sense clocks SECLK7 to SECLK12. The 43rd to 48th stages STG43 to STG48 are sequentially connected to the seventh to 12th scan clocks SCCLK7 to SCCLK12 and sequentially connected to the seventh to 12th sense clocks SECLK7 to SECLK12.

Like in the first and second exemplary embodiments, the gate driver according to the third exemplary embodiment outputs a scan signal and a sense signal in synchronization with scan clock and sense clock timings. A detailed description of how a pixel operates by the scan signal and the sense signal will be omitted since it is similar or identical to what has been described in the foregoing exemplary embodiments.

In the third exemplary embodiment, the duty cycle of a light-emission period may be set to (48n+24)lines/number of frame lines.

For example, when the pixel lines displaying an image on the display panel 10 are made up of first to 2160th pixel lines HL1 to HL2160 and n is set to 22, the duty cycle is 1080/2160. That is, when n is set to 22, a display device with 2,160 pixel lines has a 50% duty cycle according to the third exemplary embodiment. That is, when n is set to 22, black data is written to the first to eighth pixel lines during the black data insertion period BDI which comes immediately after 1080 horizontal lines.

Fourth Exemplary Embodiment

Figure 19:
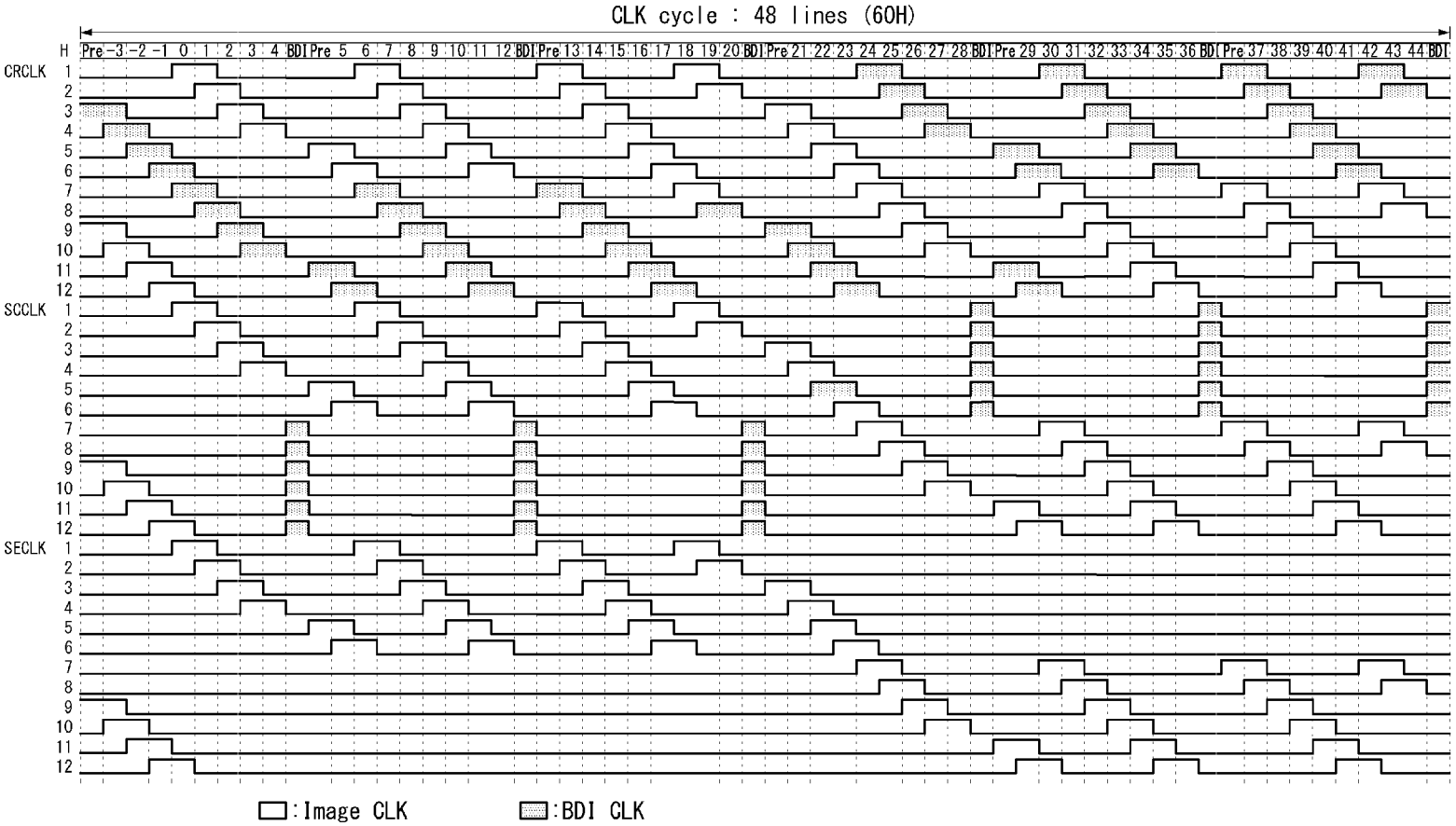
FIG. 19 is a view showing timings of clocks according to a fourth exemplary embodiment.
Figure 21:
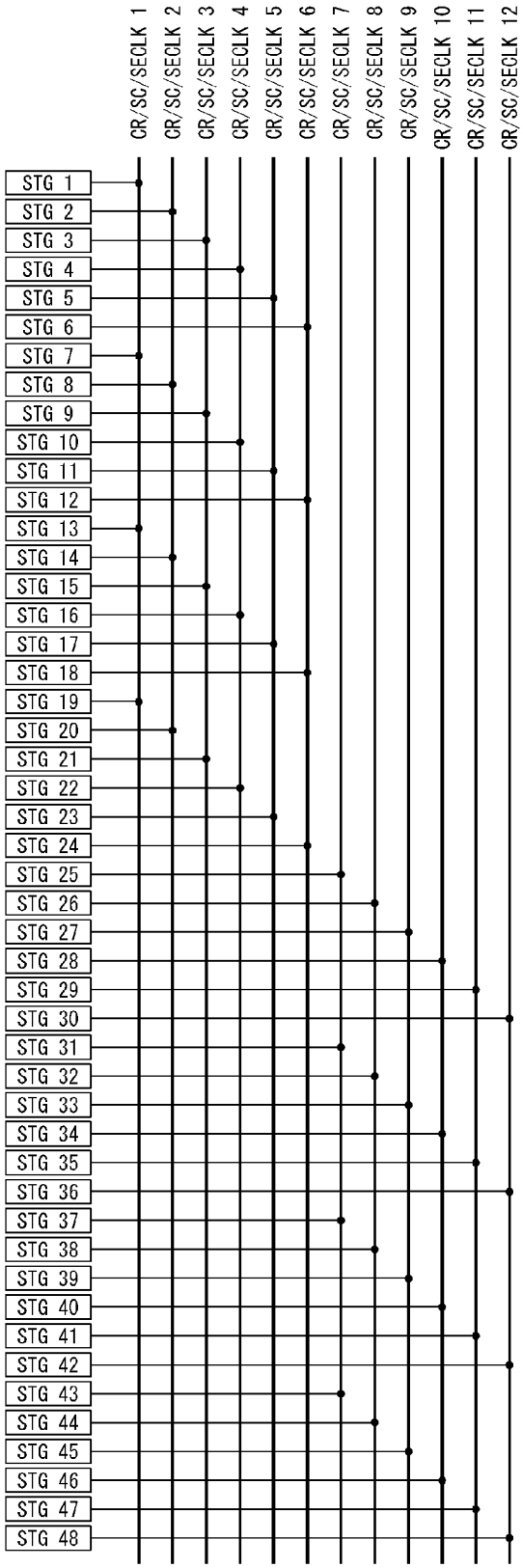

FIG. 19 is a view showing the timings of carry clocks, scan clocks, and sense clocks according to the fourth exemplary embodiment. FIGS. 20 and 21 are views showing how the stages and the carry clocks, scan clocks, and sense clocks are connected.

As shown in FIG. 19, the carry clocks CRCLK, scan clocks SCCLK, and sense clocks SECLK each have 12 phases. The carry clocks CRCLK, scan clocks SCCLK, and sense clocks SECLK have one cycle of 60 horizontal periods. In the fourth exemplary embodiment, the gate driver 13 drives 48 pixel lines during one cycle. In one cycle, the black data insertion period BDI occurs six times, and the precharge period also occurs six times.

The turn-on voltage of the first to 12th carry clocks CRCLK1 to CRCLK12 may be divided for an image clock and a BDI clock. The first to 12th carry clocks CRCLK1 to CRCLK12 maintain the turn-on voltage during 2 horizontal periods and the turn-off voltage during 8 horizontal periods.

In one cycle, the first to fourth turn-on voltages of the first to sixth carry clocks CRCLK1 to CRCLK6 correspond to image clocks, and the fifth to eighth turn-on voltages correspond to BDI clocks. In one cycle, the first to fourth turn-on voltages of the seventh to 12th carry clocks CRCLK7 to CRCLK12 correspond to BDI clocks, and the fifth to eighth turn-on voltages correspond to image clocks.

The first to sixth scan clocks SCCLK1 to SCCLK6 are sequentially outputted a total of four times during first to 24th horizontal periods 1H to 24H. The seventh to 12th scan clocks SCCLK7 to SCCLK12 are sequentially outputted a total of four times during 25th to 48th horizontal periods 25H to 48H. Also, the first to sixth scan clocks SCCLK1 to SCCLK6 maintain the turn-on voltage during the fourth to sixth black data insertion periods BDI, and the seventh to 12th scan clocks SCCLK7 to SCCLK12 maintain the turn-on voltage during the first to third black data insertion periods BDI.

The first to 12th sense clocks SECLK1 to SECLK12 are synchronized with the image clocks of the first to 12th scan clocks SCCLK1 to SCCLK12.

Referring to FIGS. 20 and 21, the first to sixth stages STG1 to STG6 are sequentially connected to the first to sixth carry clocks CRCLK1 to CRCLK6, sequentially connected to the first to sixth scan clocks SCCLK1 to SCCLK6, and sequentially connected to the first to sixth sense clocks SECLK1 to SECLK6. The seventh to twelfth stages STG7 to STG12 are sequentially connected to the first to sixth carry clocks CRCLK1 to CRCLK6, sequentially connected to the first to sixth scan clocks SCCLK1 to SCCLK6, and sequentially connected to the first to sixth sense clocks SECLK1 to SECLK6. Also, the 13th to 18th stages STG13 to STG18 are sequentially connected to the first to sixth carry clocks CRCLK1 to CRCLK6, sequentially connected to the first to sixth scan clocks SCCLK1 to SCCLK6, and sequentially connected to the first to sixth sense clocks SECLK1 to SECLK6.

The 19th to 30th stages STG19 to STG30 are sequentially connected to the first to 12th carry clocks CRCLK1 to CRCLK12, sequentially connected to the first to 12th scan clocks SCCLK1 to SCCLK12, and sequentially connected to the first to 12th sense clocks SECLK1 to SECLK12.

The 31st to 36th stages STG31 to STG36 are sequentially connected to the seventh to 12th carry clocks CRCLK7 to CRCLK12, sequentially connected to the seventh to 12th scan clocks SCCLK7 to SCCLK12, and sequentially connected to the seventh to 12th sense clocks SECLK7 to SECLK12.

The 37th to 42nd stages STG37 to STG42 are sequentially connected to the seventh to 12th carry clocks CRCLK7 to CRCLK12, sequentially connected to the seventh to 12th scan clocks SCCLK7 to SCCLK12, and sequentially connected to the seventh to 12th sense clocks SECLK7 to SECLK12.

The 43rd to 48th stages STG43 to STG48 are sequentially connected to the seventh to 12th carry clocks CRCLK7 to CRCLK12, sequentially connected to the seventh to 12th scan clocks SCCLK7 to SCCLK12, and sequentially connected to the seventh to 12th sense clocks SECLK7 to SECLK12.

Like in the foregoing exemplary embodiments, the gate driver according to the fourth exemplary embodiment outputs a scan signal and a sense signal in synchronization with scan clock and sense clock timings. A detailed description of how a pixel operates by the scan signal and the sense signal will be omitted since it is similar or identical to what has been described in the foregoing exemplary embodiments.

In the fourth exemplary embodiment, the duty cycle of a light-emission period may be set to (48n+24)lines/number of frame lines.

For example, when the pixel lines displaying an image on the display panel 10 are made up of first to 2160th pixel lines HL1 to HL2160 and n is set to 22, the duty cycle is 1080/2160. That is, when n is set to 22, a display device with 2,160 pixel lines has a 50% duty cycle according to the fourth exemplary embodiment. That is, when n is set to 22, black data is written to the first to eighth pixel lines during the black data insertion period BDI which comes immediately after 1080 horizontal lines.

As described above, the organic light-emitting display according to the present disclosure may improve motion picture response time by using a black data display period. Particularly, the organic light-emitting display according to the present disclosure may display black data without changing driving frequency. That is, it is possible to improve motion picture response time by inserting black data without reducing the length of a programming period.

Moreover, the organic light-emitting display according to the present disclosure may easily vary the duty cycle according to the n value. When a fast moving image is displayed, the duty cycle is decreased to improve MPRT, and when a still pattern is displayed, the duty cycle is decreased to near 100% to prevent flicker. The duty cycle may be adjusted for each frame through image processing, thereby giving the best picture quality to the user.

As discussed above, the present disclosure allows for driving pixel lines in separate blocks and enables BDI by writing an image sequentially to one block of pixel lines using an image clock signal and writing black data simultaneously to the subsequent block of pixel lines using a BDI clock signal.

Figure 22:
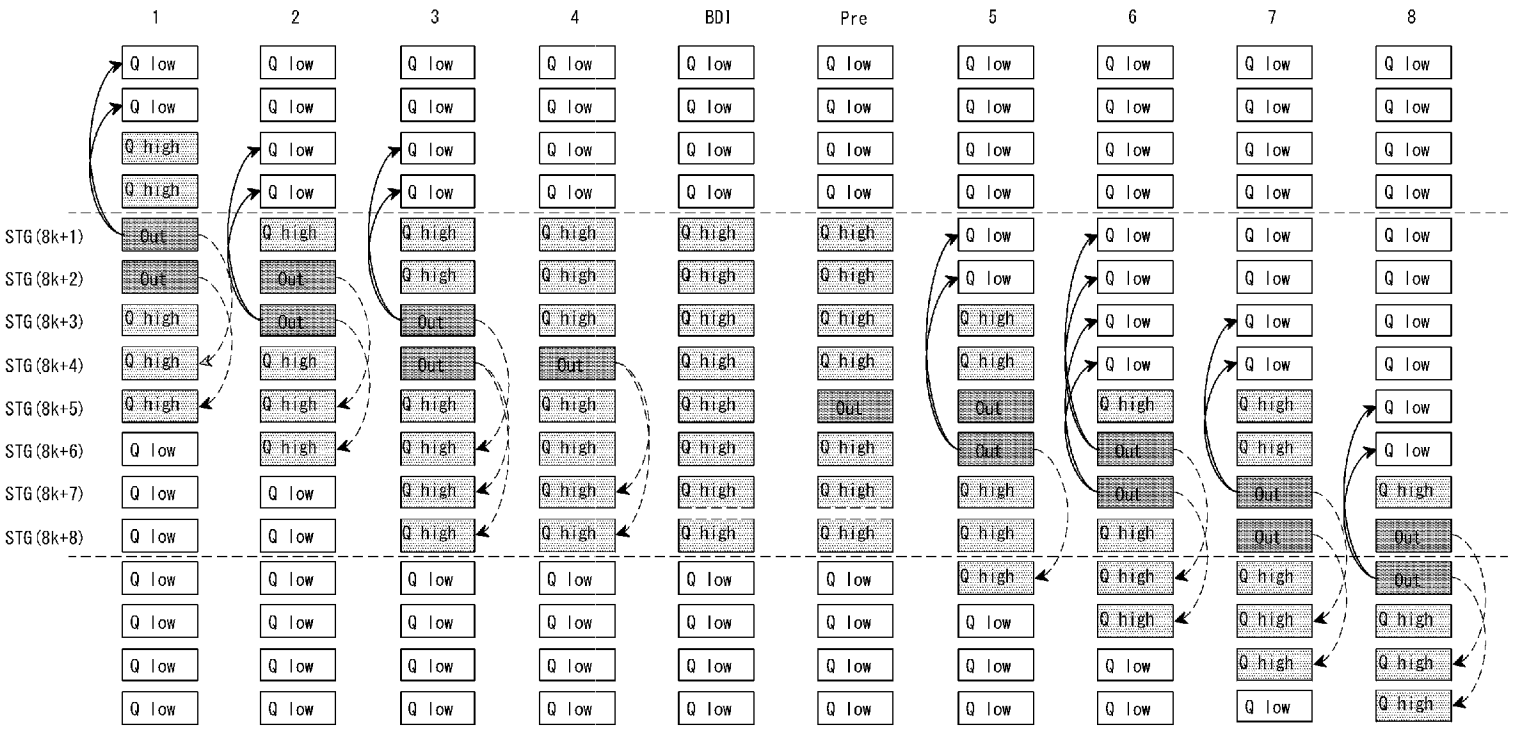
FIGS. 22 and 23 are views showing Q node voltage variation in a bidirectional scan mode of a shift register according to the foregoing first to fourth exemplary embodiments.

FIG. 22 is a view showing Q node voltage variation of stages according to the foregoing first to fourth exemplary embodiments. In FIG. 22, reference numeral 'Out' denotes stages that output a carry signal, reference numeral 'Q high' denotes stages that do not output a carry signal but maintain the turn-on voltage. Reference numeral 'Q low' denotes stages in which the Q node has the turn-off voltage. In FIG. 22, the horizontal axis represents first to eighth horizontal periods and a black data insertion period BDI and precharge period Pre inserted between them. In FIG. 22, the vertical axis represents stages. In FIG. 22, the dotted lines indicate that the output of the corresponding stage is used as a carry signal for charging the Q node of the succeeding stage, and the solid lines indicate that the output of the corresponding stage is used as a carry signal for resetting the Q node of the preceding stage to the turn-off voltage. The stage preceding the kth stage is one of the first to (k−1)th stages, and the stage succeeding the kth stage is one of the (k+1)th to last stages.

Referring to FIG. 22, in the display device according to the foregoing first to fourth exemplary embodiments of the present disclosure, black data is written simultaneously to 8 pixel lines during the black data insertion period BDI. In order to write black data simultaneously to 8 pixel lines, the Q nodes of (8k+1)th stage STG[8k+1] to (8k+8)th stage STG[8k+8] maintain the turn-on voltage during the black data insertion period BDI. Although the (8k+1)th stage STG[8k+1] to (8k+8)th stage STG[8k+8] output no carry signal in the black data insertion period BDI, the Q nodes of these stages maintain the turn-on voltage. This is because, in the black data insertion period BDI, a scan signal SCAN has to be outputted through the second output terminal n2, even if the first to third output terminals n1 to n3 maintain the turn-off voltage. Moreover, the Q nodes maintaining the turn-on voltage in the black data insertion period BDI have a turn-on voltage for the stages which is turned on in the precharge period Pre.

Subsequently, during the precharge period Pre, the (8k+5)th stage STG[8k+5] outputs a (8k+5)th carry signal CARRY[8k+5] in response to a carry clock signal applied to the first pull-up transistor Tpu_CR.

In order for the Q nodes of the eight stages to maintain the charged state in the black data insertion period BDI, the Q node of each pixel line has to remain turned-on for a minimum of (8×1) horizontal periods or more, as shown in FIGS. 7 and 8. Accordingly, as shown in FIG. 6, while a (i−3)th carry signal CARRY(i−3) is used to charge the Q nodes of the stages, a (i+5)th carry signal CARRY(i+5) is used to reset the Q node to the turn-off voltage.

Moreover, in the present disclosure, the carry signals applied to the stages are different from carry signals applied to a common shift register, due to the black data insertion period BDI in which no carry signal is outputted. That is, in the common shift register, the interval between the application of the carry signals to the stages and the bootstrapping of the Q nodes is the same. However, in the present disclosure, the interval between the application of the carry signals to the stages and the bootstrapping of the Q nodes may vary as shown in FIG. 22, due to the black data insertion period BDI. For example, the Q node of the (8k+1)th stage STG[8k+1] is reset by the carry signal of the (8k+6)th stage STG[8k+6] corresponding to the (i+5)th stage outputs during the fifth horizontal period. On the contrary, the Q node of the (8k+2)th stage STG[8k+2] is reset by the carry signal the (8k+6)th stage STG[8k+6] corresponding to the (i+4)th stage outputs during the fifth horizontal period.

Even if there is a difference in the period of time in which the Q node maintains the charged state, relative to the output timing of the stages, the shift register works smoothly. However, a change in the scan direction of the shift register may cause malfunction.

This will be described in further details.

A common shift register generates a scan pulse in a single direction—that is, from the uppermost stage to the lowermost stage. As the range of applications of the display device is widened, a driving circuit part mounted on the display panel is not limited to a certain position. To apply the display panel in various models of display, a bidirectional shift register may be used, which is a single shift register that outputs a scan pulse from the uppermost side or from the lowermost side.

In the shift register, the operation of the stages comprises a setting operation for charging the Q node with the turn-on voltage and a reset operation for discharging the Q node to the turn-off voltage.

In the shift register, forward and reverse outputs are opposite in the setting operation and reset operation. That is, the setting operation for the forward output is the reset operation for the reverse output, and the reset operation for the reverse output is the setting operation for the forward output.

Accordingly, a clock signal for controlling the setting operation and a clock signal for controlling the reset operation have to be symmetrical.

Figure 23:
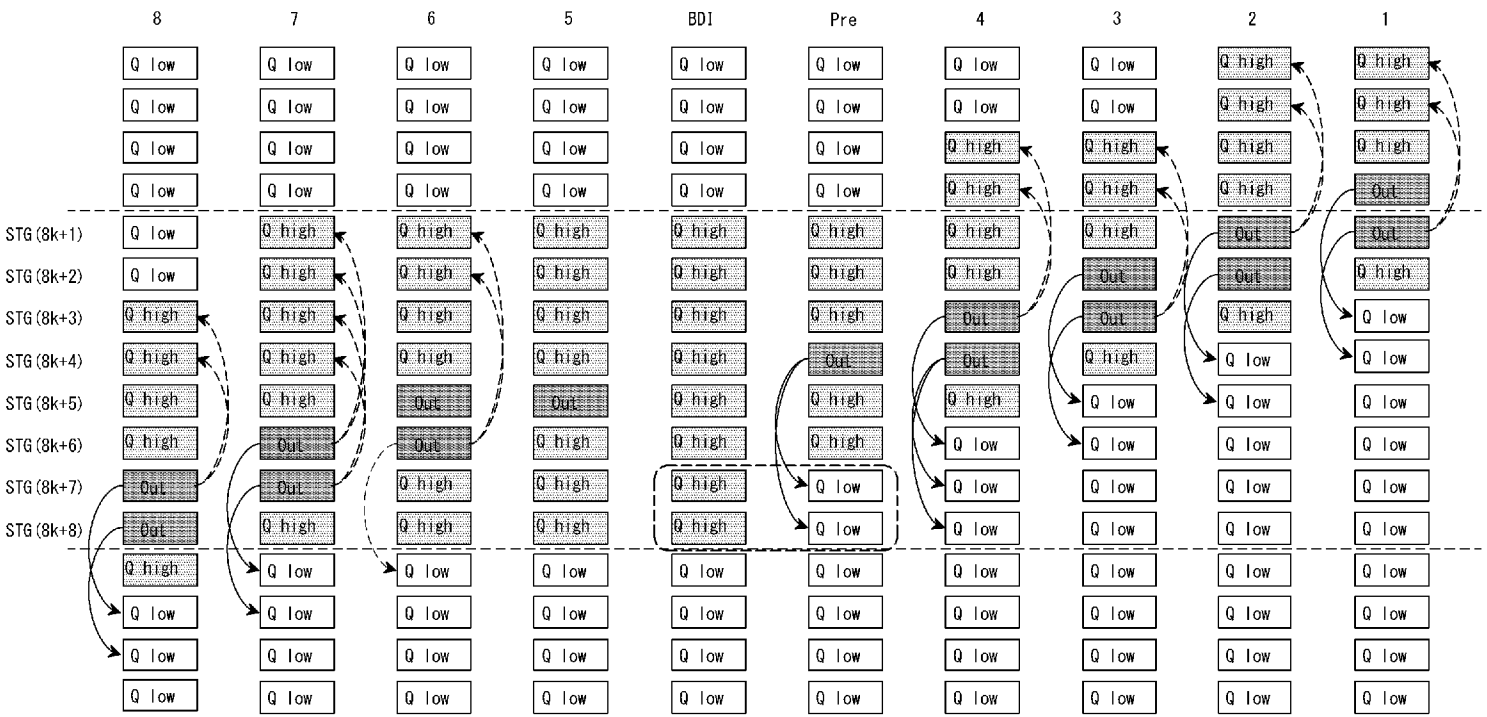

FIG. 23 is a view showing reverse outputting of the carry signals shown in FIG. 22. In a bidirectional shift register based on the carry signals shown in FIG. 22, the voltage margin at the Q node may be insufficient in some parts as shown in FIG. 23.

This is because, in a forward scan mode and a reverse scan mode, a transistor charging the Q node and a transistor discharging the Q node play opposite roles. That is, the transistor charging the Q node in the forward scan mode discharges the Q node in the reverse scan mode, and the transistor discharging the Q node in the forward scan mode charges the Q node in the reverse scan mode.

Thus, if the interval between the charging of the Q nodes and the bootstrapping of the Q nodes in the stages is different from the interval between the discharging of the Q nodes and the bootstrapping of the Q nodes as shown in FIG. 22, the eight stages may not be able to maintain the turn-on voltage in the precharge period Pre as shown in FIG. 23.

Hereinafter, an example of a shift register capable of bidirectional scanning while using the clock signals explained in the first to fourth exemplary embodiments will be described.

Figure 24:
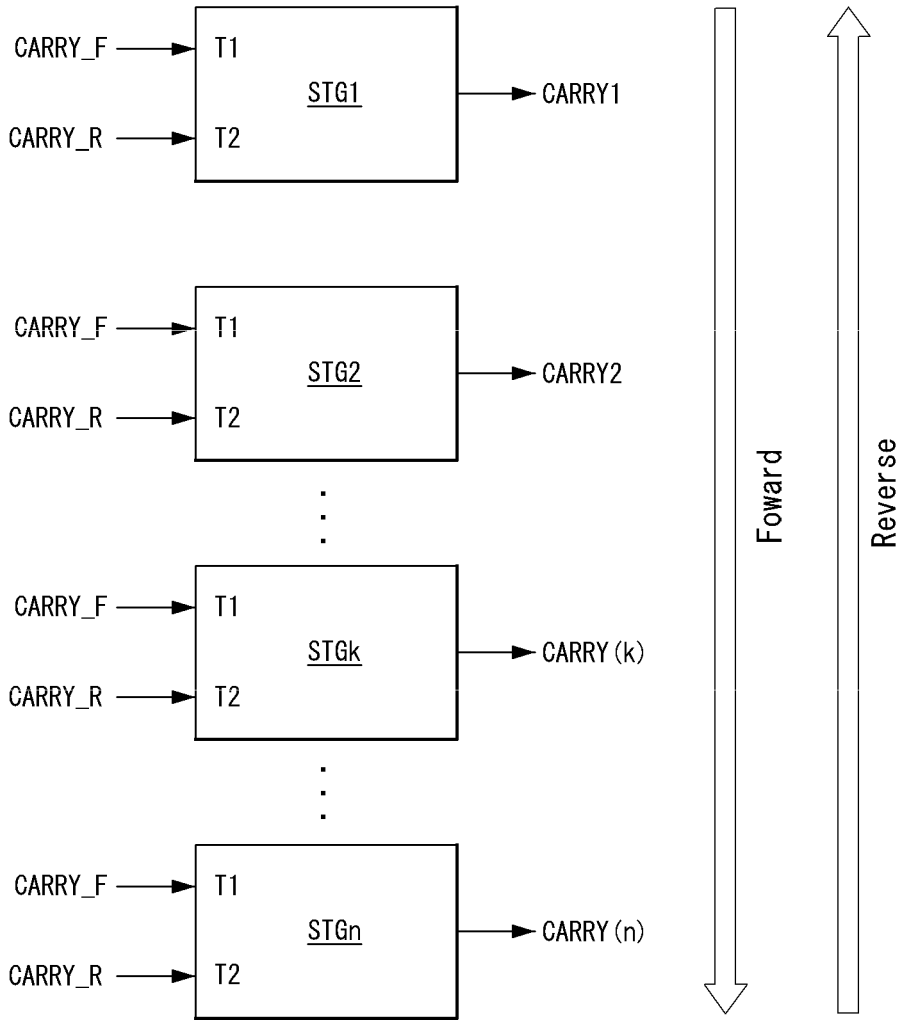
FIGS. 24 and 25 are views showing a shift register and stages for a bidirectional scan mode operation according to the present disclosure.
Figure 25:
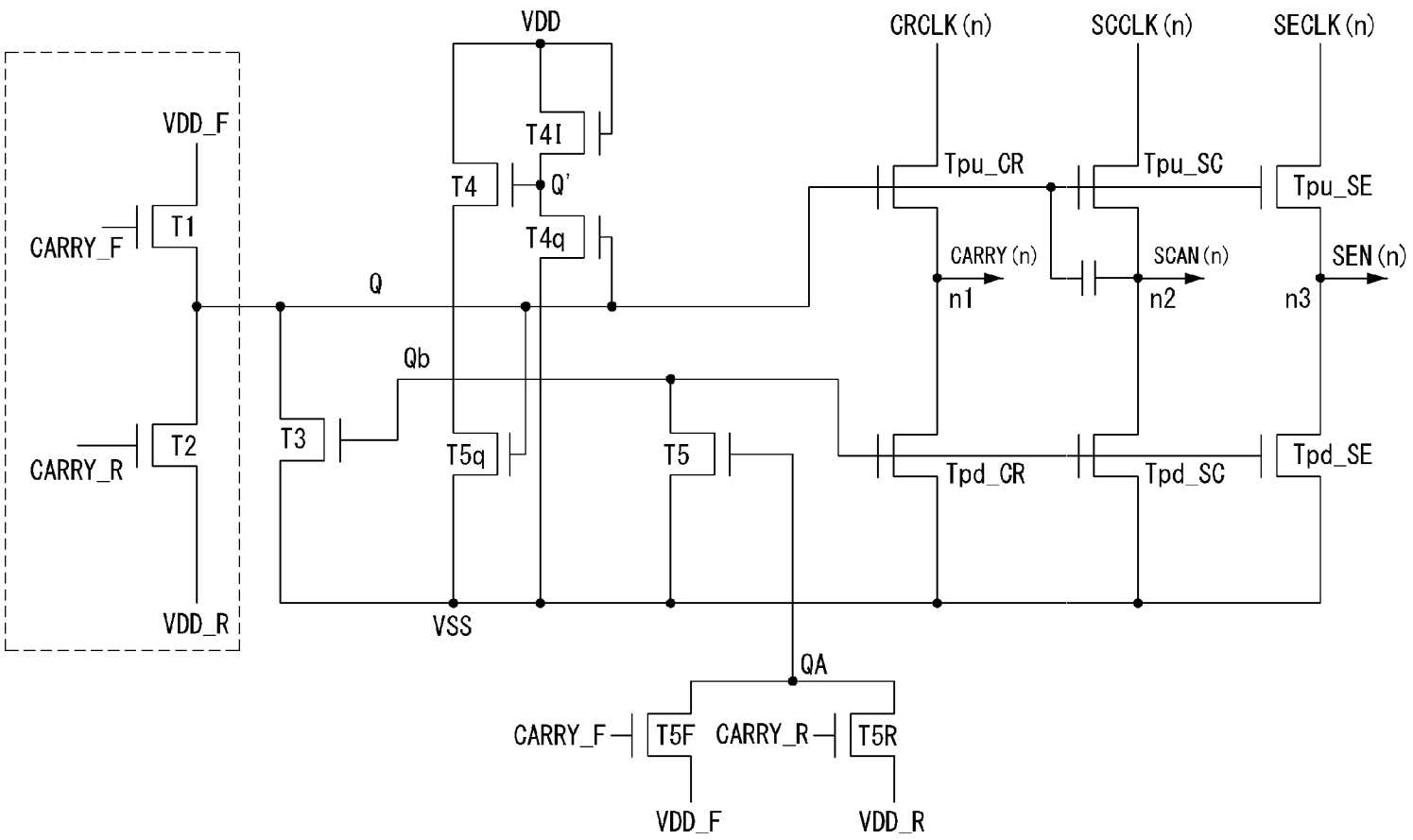

FIG. 24 is a view showing a bidirectional shift register, and FIG. 25 is a view showing the nth stage of the bidirectional shift register shown in FIG. 24.

Referring to FIG. 24, the shift register comprises first to nth stages STG1 to STGn. The first to nth stages STG1 to STGn control the Q nodes by a Q node controller T1 and T2 and sequentially output carry signals. The Q node controller T1 and T2 comprises first and second transistors T1 and T2. The first transistor T1 receives a forward carry signal CARRY_F, and the second transistor T2 receives a reverse carry signal CARRY_R.

In the forward scan mode, the first transistor T1 charges the Q node in response to the forward carry signal CARRY_F, and resets the Q node to the turn-off voltage in response to the reverse carry signal CARRY_R.

In the reverse scan mode, the second transistor T2 charges the Q node in response to the reverse carry signal CARRY_R, and resets the Q node to the turn-off voltage in response to the forward carry signal CARRY_F.

Referring to FIG. 25, the nth stage STG[n] of the bidirectional shift register comprises a first transistor T1, a second transistor T2, a Q node holding part T3, an inverter part, first to third pull-up transistors Tpu_CR, Tpu_SC, and Tpu_SE, and first to third pull-down transistors Tpd_CR, Tpd_SC, and Tpd_SE.

In FIG. 25, a forward driving voltage VDD_F and a reverse driving voltage VDD_R vary with the scan mode. Table 1 below is a table showing the voltage levels of the forward driving voltage and reverse driving voltage in different scan modes.

TABLE 1

| | Forward Scan Mode | Reverse Scan mode |
|---|---|---|
| VDD_F | VGH | VGL |
| VDD_R | VGL | VGH |

Referring to Table 1, the forward driving voltage VDD_F maintains the high-potential voltage (VGH) of the turn-on voltage level in the forward scan mode and maintains the low-potential voltage (VGL) of the turn-off voltage level in the reverse scan mode. The reverse driving voltage VDD_R maintains the high-potential voltage of the turn-on voltage level in the reverse scan mode and maintains the low-potential voltage of the turn-off voltage level in the forward scan mode.

The first transistor T1 comprises a gate electrode that receives the forward carry signal CARRY_F, a drain electrode connected to an input terminal of the forward driving voltage VDD_F, and a source electrode connected to the Q node.

The second transistor T2 comprises a gate electrode that receives the reverse carry signal CARRY_R, a drain electrode connected to the Q node, and a source electrode connected to an input terminal of the reverse driving voltage VDD_R.

The Q node holding part T3 applies the turn-off voltage to the Q node when a QB node has the turn-on voltage. To this end, the Q node holding part T3 comprises a gate electrode connected to the QB node, a drain electrode connected to the Q node, and a source electrode connected to an input terminal of the low-potential voltage VGL.

The inverter part comprises a fourth transistor T4, a Q' pull-up transistor T4I, a Q' pull-down transistor T4*q*, a fifth transistor T5, a Qb pull-down transistor T5*q*, a forward QA pull-up transistor TSF, and a reverse QA pull-up transistor TSR.

The fourth transistor T4 applies the turn-on voltage to the QB node when a Q' node has the turn-on voltage. To this end, the fourth transistor T4 comprises a gate electrode connected to the Q' node, a drain electrode connected to an input terminal of the high-potential voltage VDD, and a source electrode connected to the QB node.

The Q' pull-up transistor T4I comprises a gate electrode and drain electrode connected to the input terminal of the high-potential voltage VDD and a source electrode connected to the Q' node. The Q' pull-up transistor T4I performs a diode function to stably supply the high-potential voltage VDD to the Q' node.

The Q' pull-down transistor T4*q* comprises a gate electrode connected to the Q node, a drain electrode connected to the Q' node, and a source electrode connected to the input terminal of the low-potential voltage VSS. The Q' pull-down transistor T4*q* maintains the turn-off voltage at the Q' node when the Q node is charged with the turn-on voltage.

The Qb pull-down transistor T5*q* comprises a gate electrode connected to the Q node, a drain electrode connected to the QB node, and a source electrode connected to the input terminal of the low-potential voltage VSS. The Qb pull-down transistor T5*q* maintains the low-potential voltage VSS at the QB node when the Q node has the turn-on voltage.

The fifth transistor T5 comprises a gate electrode connected to a QA node, a drain electrode connected to the QB node, and a source electrode connected to the input terminal of the low-potential voltage VSS.

The forward QA pull-up transistor T5F comprises a gate electrode that receives the forward carry signal CARRY_F, a drain electrode connected to the input terminal of the forward driving voltage VDD_F, and a source electrode connected to the QA node.

The reverse QA pull-up transistor T5R comprises a gate electrode that receives the reverse carry signal CARRY_R, a drain electrode connected to the input terminal of the reverse driving voltage VDD_R, and a source electrode connected to the QA node.

The first pull-up transistor Tpu_CR comprises a gate electrode connected to the Q node, a drain electrode that receives a carry clock CRCLK, and a source electrode connected to a first output terminal n1. When the Q node is in the charged state, the first pull-up transistor Tpu_CR outputs a carry signal CARRY[n] to the first output terminal n1 by using the carry clock CRCLK inputted into the drain electrode.

The second pull-up transistor Tpu_SC comprises a gate electrode connected to the Q node, a drain electrode that receives a scan clock SCCLK, and a source electrode connected to a second output terminal n2. When the Q node is in the charged state, the second pull-up transistor Tpu_SC outputs a scan signal SCAN[n] to the second output terminal n2 by using the scan clock SCCLK inputted into the drain electrode.

The third pull-up transistor Tpu_SE comprises a gate electrode connected to the Q node, a drain electrode that receives a sense clock SECLK, and a source electrode connected to a third output terminal n3. When the Q node is in the charged state, the third pull-up transistor Tpu_SE outputs a sense signal SEN[n] to the third output terminal n3 by using the sense clock SECLK inputted into the drain electrode.

The first pull-down transistor Tpd_CR comprises a gate electrode connected to the QB node, a drain electrode connected to the input terminal of the low-potential voltage VSS, and a source electrode connected to the first output terminal n1. The first pull-down transistor Tpd_CR discharges the first output terminal n1 to the low-potential voltage VSS, in response to a QB node voltage.

The second pull-down transistor Tpd_SC comprises a gate electrode connected to the QB node, a drain electrode connected to the input terminal of the low-potential voltage VSS, and a source electrode connected to the second output terminal n2. The second pull-down transistor Tpd_SC discharges the second output terminal n2 to the low-potential voltage VSS, in response to the QB node voltage.

The third pull-down transistor Tpd_SE comprises a gate electrode connected to the QB node, a drain electrode connected to the input terminal of the low-potential voltage VSS, and a source electrode connected to the third output terminal n3. The third pull-down transistor Tpd_SE discharges the third output terminal n3 to the low-potential voltage VSS, in response to the QB node voltage.

An example of the Q node controller will be described below.

Figure 26:
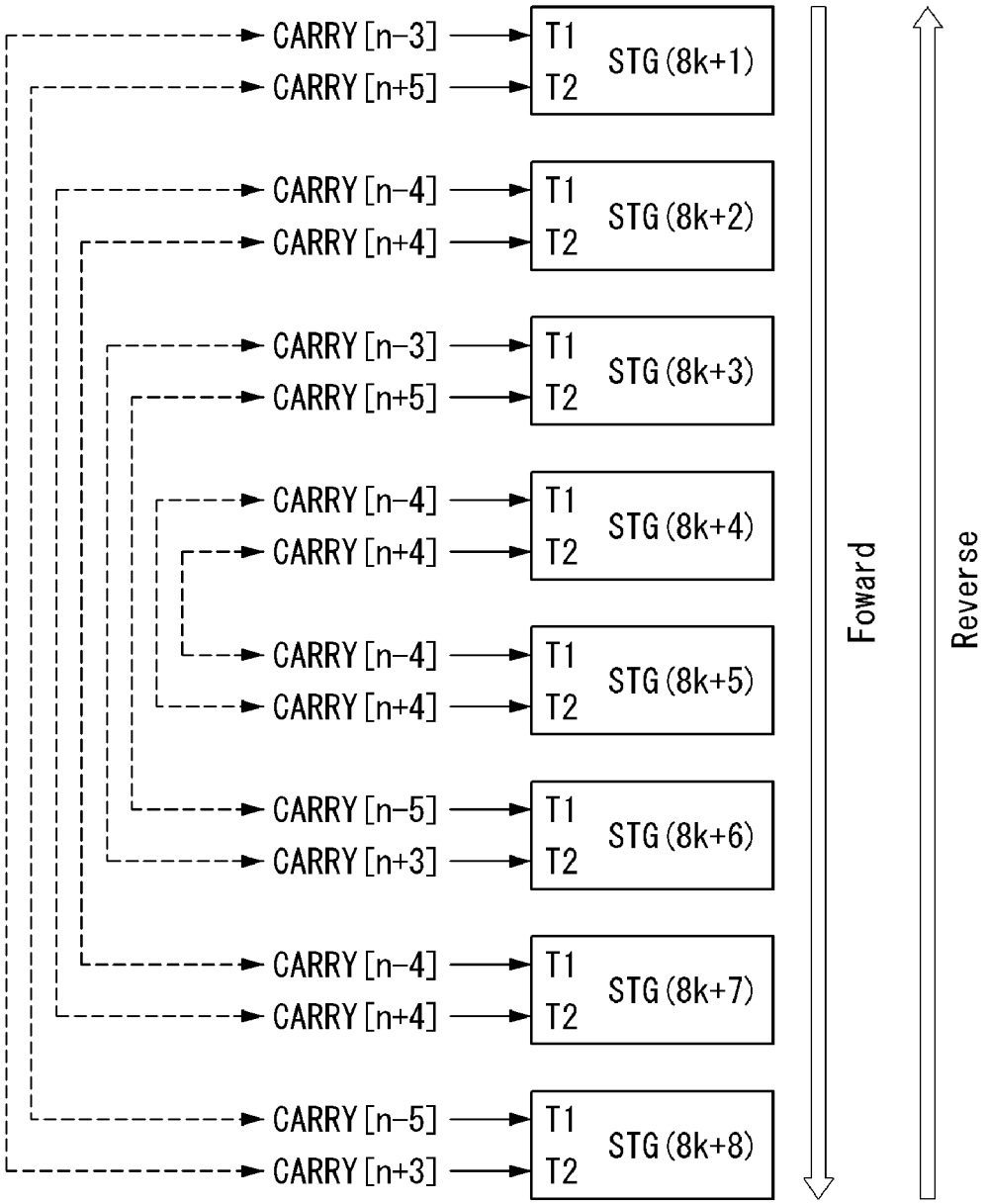
FIG. 26 is a view showing a shift register capable of bidirectional scanning according to the first exemplary embodiment.
Figure 27:
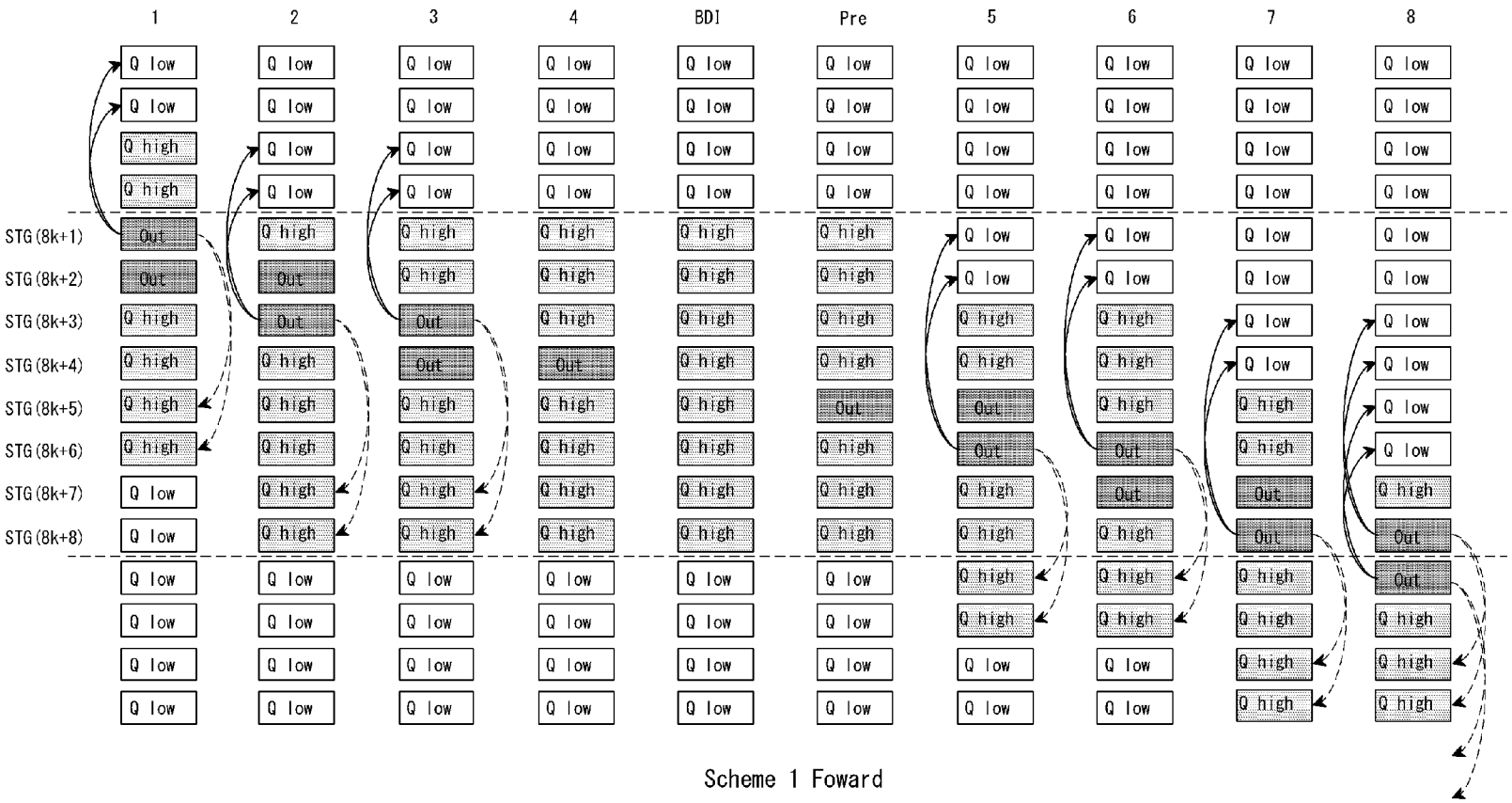
FIGS. 27 and 28 are views showing Q node voltage variation caused by the shift register capable of bidirectional scanning according to the first exemplary embodiment.
Figure 28:
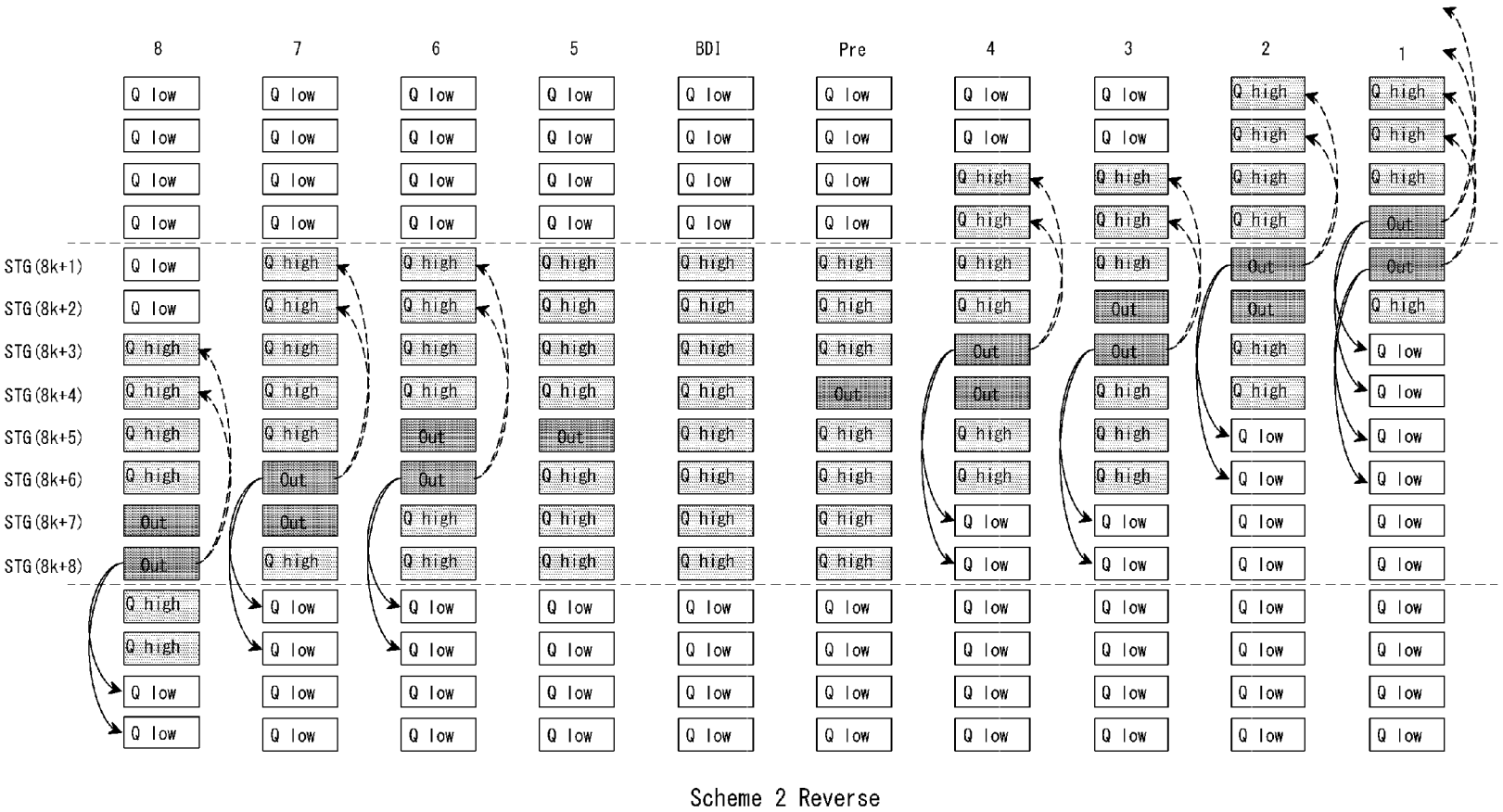

FIG. 26 is a view showing carry signals applied to the Q node controller according to the first exemplary embodiment. FIG. 27 is a view showing the timings of carry signals in the forward scan mode according to the first exemplary embodiment. FIG. 28 is a view showing the timings of carry signals in the reverse scan mode according to the first exemplary embodiment.

The first transistor T1 of each of the (8k+1)th stage STG[8k+1] to (8k+8)th stage STG[8k+8] is turned on in response to the forward carry signal CARRY_F, and the second transistor T2 thereof is turned on in response to the reverse carry signal CARRY_R. In the forward scan mode, the first transistor T1 charges the Q node, and the second transistor T2 resets the Q node. In the reverse scan mode, the second transistor T2 charges the Q node, and the first transistor T1 resets the Q node. The Q node reset operation refers to applying the turn-off voltage to the Q node.

Consequently, the operation of stages in the forward scan mode according to the first exemplary embodiment will be described below.

The first transistor T1 of the (8k+1)th stage STG[8k+1] charges the Q node in response to a (n−3)th carry signal CARRY[n−3], and the second transistor T2 thereof resets the Q node in response to a (n+5)th carry signal CARRY [n+5].

The first transistor T1 of the (8k+2)th stage STG[8k+2] charges the Q node in response to a (n−4)th carry signal CARRY[n−4], and the second transistor T2 thereof resets the Q node in response to a (n+4)th carry signal CARRY [n+4].

The first transistor T1 of the (8k+3)th stage STG[8k+3] charges the Q node in response to the (n−3)th carry signal CARRY[n−3], and the second transistor T2 thereof resets the Q node in response to the (n+5)th carry signal CARRY [n+5].

The first transistor T1 of the (8k+4)th stage STG[8k+4] charges the Q node in response to the (n−4)th carry signal CARRY[n−4], and the second transistor T2 thereof resets the Q node in response to the (n+4)th carry signal CARRY [n+4].

The first transistor T1 of the (8k+5)th stage STG[8k+5] charges the Q node in response to the (n−4)th carry signal CARRY[n−4], and the second transistor T2 thereof resets the Q node in response to the (n+4)th carry signal CARRY [n+4].

The first transistor T1 of the (8k+6)th stage STG[8k+6] charges the Q node in response to a (n−5)th carry signal CARRY[n−5], and the second transistor T2 thereof resets the Q node in response to a (n+3)th carry signal CARRY [n+3].

The first transistor T1 of the (8k+7)th stage STG[8k+7] charges the Q node in response to the (n−4)th carry signal CARRY[n−4], and the second transistor T2 thereof resets the Q node in response to the (n+4)th carry signal CARRY [n+4].

The first transistor T1 of the (8k+8)th stage STG[8k+8] charges the Q node in response to the (n−5)th carry signal CARRY[n−5], and the second transistor T2 thereof resets the Q node in response to the (n+3)th carry signal CARRY [n+3].

In the reverse scan mode, the second transistor T2 charges the Q node in response to the reverse carry signal, and the first transistor T1 resets the Q node in response to the forward carry signal.

The operation of stages in the reverse scan mode according to the first exemplary embodiment will be described below.

The second transistor T2 of the (8k+8)th stage STG[8k+8] charges the Q node in response to the (n+3)th carry signal CARRY[n+3], and the first transistor T1 thereof resets the Q node in response to the (n−5)th carry signal CARRY[n−5].

The second transistor T2 of the (8k+7)th stage STG[8k+7] charges the Q node in response to the (n+4)th carry signal CARRY[n+4], and the first transistor T1 thereof resets the Q node in response to the (n−4)th carry signal CARRY[n−4].

The second transistor T2 of the (8k+6)th stage STG[8k+6] charges the Q node in response to the (n+3)th carry signal CARRY[n+3], and the first transistor T1 thereof resets the Q node in response to the (n−5)th carry signal CARRY[n−5].

The second transistor T2 of the (8k+5)th stage STG[8k+5] charges the Q node in response to the (n+4)th carry signal CARRY[n+4], and the first transistor T1 thereof resets the Q node in response to the (n−4)th carry signal CARRY[n−4].

The second transistor T2 of the (8k+4)th stage STG[8k+4] charges the Q node in response to the (n+4)th carry signal CARRY[n+4], and the first transistor T1 thereof resets the Q node in response to the (n−4)th carry signal CARRY[n−4].

The second transistor T2 of the (8k+3)th stage STG[8k+3] charges the Q node in response to the (n+5)th carry signal CARRY[n+5], and the first transistor T1 thereof resets the Q node in response to the (n−3)th carry signal CARRY[n−3].

The second transistor T2 of the (8k+2)th stage STG[8k+2] charges the Q node in response to the (n+4)th carry signal CARRY[n+4], and the first transistor T1 thereof resets the Q node in response to the (n−4)th carry signal CARRY[n−4].

The second transistor T2 of the (8k+1)th stage STG[8k+1] charges the Q node in response to the (n+5)th carry signal CARRY[n+5], and the first transistor T1 thereof resets the Q node in response to the (n−3)th carry signal CARRY[n−3].

The output timing of the (n−3)th carry signal CARRY[n−3] in the forward scan mode is the same as the output timing of the (n+3)th carry signal CARRY[n+3] in the reverse scan mode. That is, the Q node charge timing of the (8k+1)th stage STG[8k+1] in the forward scan mode is the same as the Q node charge timing of the (8k+8)th stage STG[8k+8] in the reverse scan mode. Also, the Q node charge timing of the (n+5)th carry signal CARRY[n+5] in the forward scan mode is the same as the Q node charge timing of the (n−5)th carry signal CARRY[n−5] in the reverse scan mode. That is, the Q node reset timing of the (8k+1)th stage STG[8k+1] in the forward scan mode is the same as the Q node reset timing of the (8k+8)th stage STG[8k+8] in the reverse scan mode.

Likewise, the Q node charge timing of the (8k+2)th stage STG[8k+2] in the forward scan mode is the same as the Q node charge timing of the (8k+7)th stage STG[8k+7] in the reverse scan mode. The Q node reset timing of the (8k+2)th stage STG[8k+2] in the forward scan mode is the same as the Q node reset timing of the (8k+7)th stage STG[8k+7] in the reverse scan mode.

The Q node charge timing of the (8k+3)th stage STG[8k+3] in the forward scan mode is the same as the Q node charge timing of the (8k+6)th stage STG[8k+6] in the reverse scan mode. The Q node reset timing of the (8k+3)th stage STG[8k+3] in the forward scan mode is the same as the Q node reset timing of the (8k+6)th stage STG[8k+6] in the reverse scan mode.

The Q node charge timing of the (8k+4)th stage STG[8k+4] in the forward scan mode is the same as the Q node charge timing of the (8k+5)th stage STG[8k+5] in the reverse scan mode. The Q node reset timing of the (8k+4)th stage STG[8k+4] in the forward scan mode is the same as the Q node reset timing of the (8k+5)th stage STG[8k+5] in the reverse scan mode.

In this way, the Q node controller according to the first exemplary embodiment sets the timings of carry signals in the forward scan mode and reverse scan modes to be symmetrical within a group of stages. As a result, the Q nodes of the stages in the group have the same charge timing and the same reset timing in the forward scan mode and reverse scan mode. Due to this, the Q nodes in the stage group may maintain the charged state during the black data insertion period and the precharge period in both the forward and reverse scan modes. The number of stages of symmetry in the group corresponds to the number of pixel lines to which black data is written during the black data insertion period. Every eight stages are set in symmetrical relation to each other because the stages repeat their operation depending on the number of pixel lines to which black data is written during the black data insertion period BDI.

Figure 29:
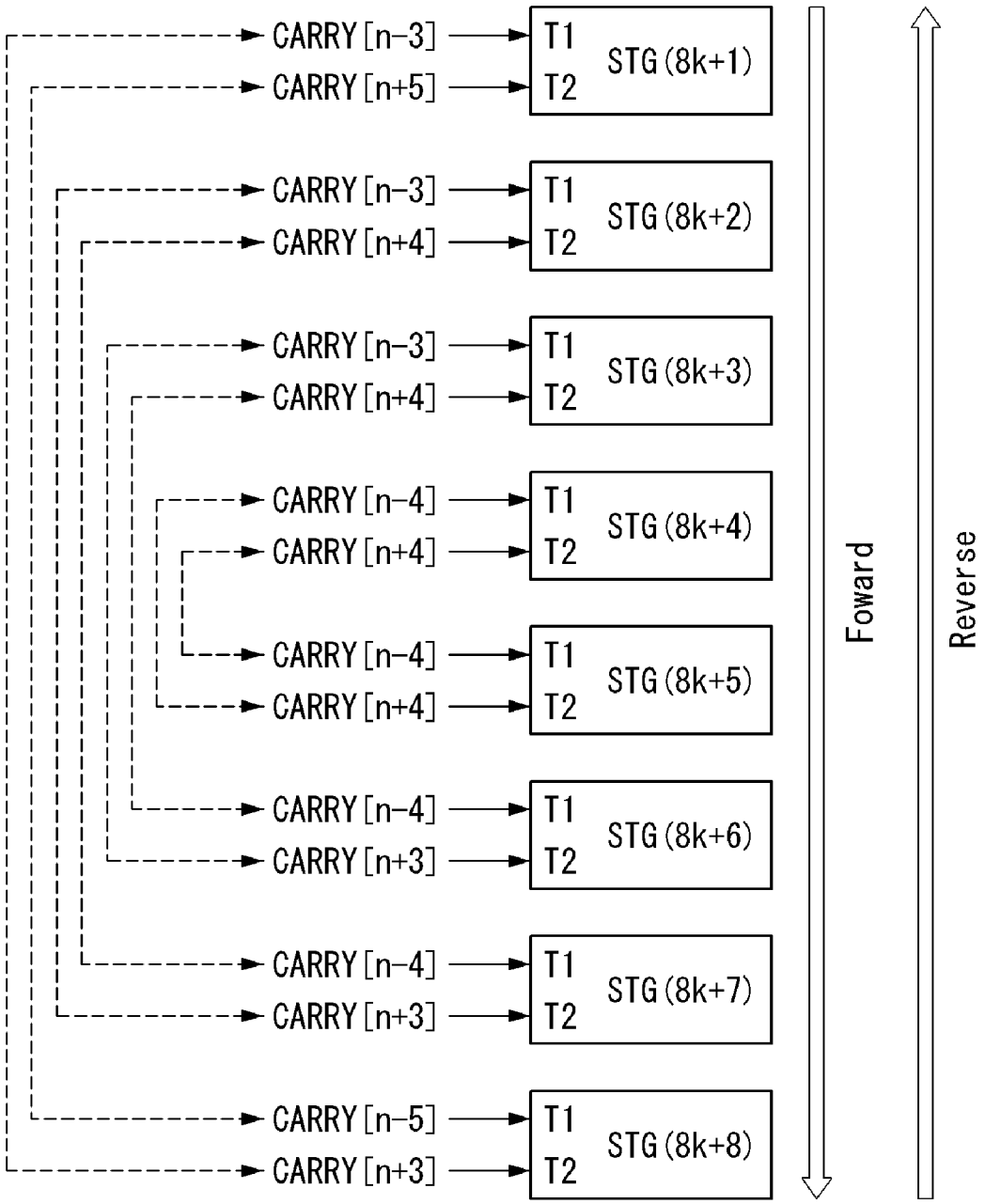
FIG. 29 is a view showing a shift register capable of bidirectional scanning according to the second exemplary embodiment.

FIG. 29 is a view showing carry signals applied to the Q node controller according to the second exemplary embodiment. The first transistor T1 of each of the (8k+1)th stage STG[8k+1] to (8k+8)th stage STG[8k+8] is turned on in response to the forward carry signal CARRY_F, and the second transistor T2 thereof is turned on in response to the reverse carry signal CARRY_R. In the forward scan mode, the first transistor T1 charges the Q node, and the second transistor T2 resets the Q node. In the reverse scan mode, the second transistor T2 charges the Q node, and the first transistor T1 resets the Q node. The Q node reset operation refers to applying the turn-off voltage to the Q node.

Consequently, the operation of stages in the forward scan mode according to the second exemplary embodiment will be described below.

The first transistor T1 of the (8k+1)th stage STG[8k+1] charges the Q node in response to a (n−3)th carry signal CARRY[n−3], and the second transistor T2 thereof resets the Q node in response to a (n+5)th carry signal CARRY [n+5].

The first transistor T1 of the (8k+2)th stage STG[8k+2] charges the Q node in response to a (n−3)th carry signal CARRY[n−3], and the second transistor T2 thereof resets the Q node in response to a (n+4)th carry signal CARRY [n+4].

The first transistor T1 of the (8k+3)th stage STG[8k+3] charges the Q node in response to the (n−3)th carry signal CARRY[n−3], and the second transistor T2 thereof resets the Q node in response to the (n+4)th carry signal CARRY [n+4].

The first transistor T1 of the (8k+4)th stage STG[8k+4] charges the Q node in response to the (n−4)th carry signal CARRY[n−4], and the second transistor T2 thereof resets the Q node in response to the (n+4)th carry signal CARRY [n+4].

The first transistor T1 of the (8k+5)th stage STG[8k+5] charges the Q node in response to the (n−4)th carry signal CARRY[n−4], and the second transistor T2 thereof resets the Q node in response to the (n+4)th carry signal CARRY [n+4].

The first transistor T1 of the (8k+6)th stage STG[8k+6] charges the Q node in response to a (n−4)th carry signal CARRY[n−4], and the second transistor T2 thereof resets the Q node in response to a (n+3)th carry signal CARRY [n+3].

The first transistor T1 of the (8k+7)th stage STG[8k+7] charges the Q node in response to the (n−4)th carry signal CARRY[n−4], and the second transistor T2 thereof resets the Q node in response to the (n+3)th carry signal CARRY [n+3].

The first transistor T1 of the (8k+8)th stage STG[8k+8] charges the Q node in response to the (n−5)th carry signal CARRY[n−5], and the second transistor T2 thereof resets the Q node in response to the (n+3)th carry signal CARRY [n+3].

In the reverse scan mode, the second transistor T2 charges the Q node in response to the reverse carry signal, and the first transistor T1 resets the Q node in response to the forward carry signal.

The operation of stages in the reverse scan mode according to the second exemplary embodiment will be described below.

The second transistor T2 of the (8k+8)th stage STG[8k+8] charges the Q node in response to the (n+3)th carry signal CARRY[n+3], and the first transistor T1 thereof resets the Q node in response to the (n−5)th carry signal CARRY[n−5].

The second transistor T2 of the (8k+7)th stage STG[8k+7] charges the Q node in response to the (n+3)th carry signal CARRY[n+3], and the first transistor T1 thereof resets the Q node in response to the (n−4)th carry signal CARRY[n−4].

The second transistor T2 of the (8k+6)th stage STG[8k+6] charges the Q node in response to the (n+3)th carry signal CARRY[n+3], and the first transistor T1 thereof resets the Q node in response to the (n−4)th carry signal CARRY[n−4].

The second transistor T2 of the (8k+5)th stage STG[8k+5] charges the Q node in response to the (n+4)th carry signal CARRY[n+4], and the first transistor T1 thereof resets the Q node in response to the (n−4)th carry signal CARRY[n−4].

The second transistor T2 of the (8k+4)th stage STG[8k+4] charges the Q node in response to the (n+4)th carry signal CARRY[n+4], and the first transistor T1 thereof resets the Q node in response to the (n−4)th carry signal CARRY[n−4].

The second transistor T2 of the (8k+3)th stage STG[8k+3] charges the Q node in response to the (n+4)th carry signal CARRY[n+4], and the first transistor T1 thereof resets the Q node in response to the (n−3)th carry signal CARRY[n−3].

The second transistor T2 of the (8k+2)th stage STG[8k+2] charges the Q node in response to the (n+4)th carry signal CARRY[n+4], and the first transistor T1 thereof resets the Q node in response to the (n−3)th carry signal CARRY[n−3].

The second transistor T2 of the (8k+1)th stage STG[8k+1] charges the Q node in response to the (n+5)th carry signal CARRY[n+5], and the first transistor T1 thereof resets the Q node in response to the (n−3)th carry signal CARRY[n−3].

Figure 30:
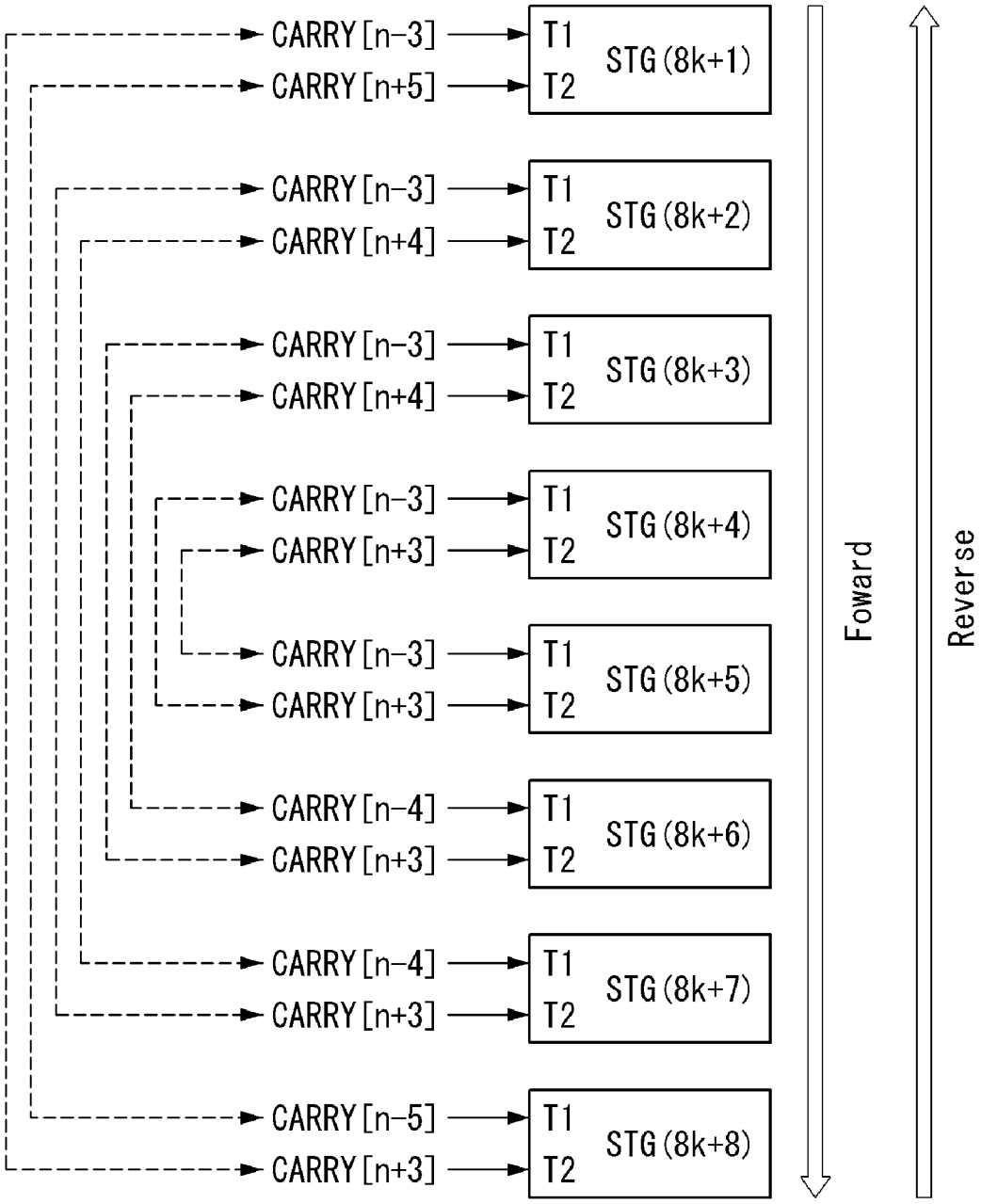
FIG. 30 is a view showing a shift register capable of bidirectional scanning according to the third exemplary embodiment.

FIG. 30 is a view showing carry signals applied to the Q node controller according to the third exemplary embodiment. The first transistor T1 of each of the (8k+1)th stage STG[8k+1] to (8k+8)th stage STG[8k+8] is turned on in response to the forward carry signal CARRY_F, and the second transistor T2 thereof is turned on in response to the reverse carry signal CARRY_R. In the forward scan mode, the first transistor T1 charges the Q node, and the second transistor T2 resets the Q node. In the reverse scan mode, the second transistor T2 charges the Q node, and the first transistor T1 resets the Q node. The Q node reset operation refers to applying the turn-off voltage to the Q node.

Consequently, the operation of stages in the forward scan mode according to the third exemplary embodiment will be described below.

The first transistor T1 of the (8k+1)th stage STG[8k+1] charges the Q node in response to a (n−3)th carry signal CARRY[n−3], and the second transistor T2 thereof resets the Q node in response to a (n+5)th carry signal CARRY [n+5].

The first transistor T1 of the (8k+2)th stage STG[8k+2] charges the Q node in response to a (n−3)th carry signal CARRY[n−3], and the second transistor T2 thereof resets the Q node in response to a (n+4)th carry signal CARRY [n+4].

The first transistor T1 of the (8k+3)th stage STG[8k+3] charges the Q node in response to the (n−3)th carry signal CARRY[n−3], and the second transistor T2 thereof resets the Q node in response to the (n+4)th carry signal CARRY [n+4].

The first transistor T1 of the (8k+4)th stage STG[8k+4] charges the Q node in response to the (n−3)th carry signal CARRY[n−3], and the second transistor T2 thereof resets the Q node in response to the (n+3)th carry signal CARRY [n+3].

The first transistor T1 of the (8k+5)th stage STG[8k+5] charges the Q node in response to the (n−3)th carry signal CARRY[n−3], and the second transistor T2 thereof resets the Q node in response to the (n+3)th carry signal CARRY [n+3].

The first transistor T1 of the (8k+6)th stage STG[8k+6] charges the Q node in response to a (n−4)th carry signal CARRY[n−4], and the second transistor T2 thereof resets the Q node in response to a (n+3)th carry signal CARRY [n+3].

The first transistor T1 of the (8k+7)th stage STG[8k+7] charges the Q node in response to the (n−4)th carry signal CARRY[n−4], and the second transistor T2 thereof resets the Q node in response to the (n+3)th carry signal CARRY [n+3].

The first transistor T1 of the (8k+8)th stage STG[8k+8] charges the Q node in response to the (n−5)th carry signal CARRY[n−5], and the second transistor T2 thereof resets the Q node in response to the (n+3)th carry signal CARRY [n+3].

In the reverse scan mode, the second transistor T2 charges the Q node in response to the reverse carry signal, and the first transistor T1 resets the Q node in response to the forward carry signal.

The operation of stages in the reverse scan mode according to the third exemplary embodiment will be described below.

The second transistor T2 of the (8k+8)th stage STG[8k+8] charges the Q node in response to the (n+3)th carry signal CARRY[n+3], and the first transistor T1 thereof resets the Q node in response to the (n−5)th carry signal CARRY[n−5].

The second transistor T2 of the (8k+7)th stage STG[8k+7] charges the Q node in response to the (n+3)th carry signal CARRY[n+3], and the first transistor T1 thereof resets the Q node in response to the (n−4)th carry signal CARRY[n−4].

The second transistor T2 of the (8k+6)th stage STG[8k+6] charges the Q node in response to the (n+3)th carry signal CARRY[n+3], and the first transistor T1 thereof resets the Q node in response to the (n−4)th carry signal CARRY[n−4].

The second transistor T2 of the (8k+5)th stage STG[8k+5] charges the Q node in response to the (n+3)th carry signal CARRY[n+3], and the first transistor T1 thereof resets the Q node in response to the (n−3)th carry signal CARRY[n−3].

The second transistor T2 of the (8k+4)th stage STG[8k+4] charges the Q node in response to the (n+3)th carry signal CARRY[n+3], and the first transistor T1 thereof resets the Q node in response to the (n−3)th carry signal CARRY[n−3].

The second transistor T2 of the (8k+3)th stage STG[8k+3] charges the Q node in response to the (n+4)th carry signal CARRY[n+4], and the first transistor T1 thereof resets the Q node in response to the (n−3)th carry signal CARRY[n−3].

The second transistor T2 of the (8k+2)th stage STG[8k+2] charges the Q node in response to the (n+4)th carry signal CARRY[n+4], and the first transistor T1 thereof resets the Q node in response to the (n−3)th carry signal CARRY[n−3].

The second transistor T2 of the (8k+1)th stage STG[8k+1] charges the Q node in response to the (n+5)th carry signal CARRY[n+5], and the first transistor T1 thereof resets the Q node in response to the (n−3)th carry signal CARRY[n−3].

As discussed above, in the shift registers according to the second and third exemplary embodiments, the Q node charge timing of the (8k+1)th stage STG[8k+1] in the forward scan mode is the same as the Q node charge timing of the (8k+8)th stage STG[8k+8] in the reverse scan mode. Also, the Q node reset timing of the (8k+1)th stage STG [8k+1] in the forward scan mode is the same as the Q node reset timing of the (8k+8)th stage STG[8k+8] in the reverse scan mode.

Likewise, the Q node charge timing of a (8k+a)th stage in the forward scan mode is the same as the Q node charge timing of a (8k+[9−a])th stage (a is a natural number less than or equal to 8) in the reverse scan mode. The Q node reset timing of the (8k+a)th stage in the forward scan mode is the same as the Q node reset timing of the (8k+[9−a])th stage in the reverse scan mode.

As stated above, according to the exemplary embodiments of the present specification, motion picture response time may be improved without increasing driving frequency by inserting black data within one frame period.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display (OLED) device comprising:

a display panel including:

a substrate;

a plurality of data lines on the substrate;

a plurality of gate lines on the substrate and oriented transverse to the data lines; and a plurality of pixels connected to the data lines and the gate lines;

a data driver that supplies data voltages to the data lines; and a gate-in-panel (GIP) gate driver that supplies gate pulses to the gate lines, wherein the gate driver drives the display panel in a plurality of blocks of pixel lines within one frame, the one frame including a plurality of cycles, each of the cycles having a data writing period, at least one black data insertion period, and at least one precharge period, wherein the data voltages are sequentially supplied to pixel lines of a jth block during the data writing period of a cycle of the plurality of cycles, and a black image is written simultaneously to pixel lines of a qth block during the at least one black data insertion period of the cycle, wherein j is a natural number, and q is a natural number different from j, wherein the gate driver comprises a plurality of stages respectively connected to the pixel lines, wherein each of the stages comprises:

a first pull-up transistor that outputs carry signals corresponding to carry clock timings, in response to a Q node voltage; and a second pull-up transistor that outputs scan signals corresponding to scan clock timings, in response to the Q node voltage, and the carry clocks comprise:

an image clock signal for charging the Q node to generate a respective one of the scan signals that are output during the data writing period; and a black data insertion (BDI) clock signal for charging the Q node to generate a respective one of the scan signals that are output during the at least one black data insertion period.

2. The OLED device of claim 1, wherein the GIP gate driver drives zk pixel lines during each cycle of the plurality of cycles, where z is a natural number greater than 1, and k is a natural number that satisfies: $z(k-1)<$a total number of the pixel lines$\leq zk$, wherein, during a data writing period having zk horizontal periods, the GIP gate driver sequentially outputs scan signals and the data driver supplies data voltages to the zk pixel lines, and, during k black data insertion periods, the GIP gate driver simultaneously supplies scan signals to z pixel lines and the data driver writes black data simultaneously to the z pixel lines.

3. The OLED device of claim 1, wherein each of the at least one black data insertion period lasts for 1 horizontal period.

4. The OLED device of claim 1, wherein, during the at least one precharge period following the at least one black data insertion period, the gate driver supplies a scan signal and a sense signal to a next pixel line which is supplied with a last data voltage during the data writing period.

5. The OLED device of claim 1, wherein the carry clocks maintain a turn-off voltage during the at least one black data insertion period.

6. The OLED device of claim 1, wherein the carry clocks include 16 carry clocks, the scan clocks include 16 scan clocks, and each cycle includes 20 horizontal periods, the carry clocks are sequentially output during a period of time spanning from a first horizontal period until a sixteenth horizontal period, and an interval between the image clock signal and the BDI clock signal of the carry clocks corresponds to a portion of the data writing period of 8 horizontal periods, a black data insertion period of 1 horizontal period, and a precharge period of 1 horizontal period.

7. The OLED device of claim 6, wherein there is a time difference of 16n+8 (n is a natural number) horizontal periods between the carry clock signal for writing image data to an ith pixel line (i is a natural number) and the carry clock signal for writing black data to the ith pixel line.

8. The OLED device of claim 1, wherein the carry clocks include 16 carry clocks, the scan clocks include 16 scan clocks, and each cycle includes 40 horizontal periods, the carry clocks are sequentially output during a period of time spanning from a first horizontal period until a sixteenth horizontal period, an interval between the image clock signal and the BDI clock signal of the carry clocks corresponds to a portion of the data writing period of 8 horizontal periods, a black data insertion period of 1 horizontal period, and a precharge period of 1 horizontal period, and there is a time difference of 32n+8 (n is a natural number) horizontal periods between the carry clock signal for writing image data to an ith pixel line (i is a natural number) and the carry clock signal for writing black data to the ith pixel line.

9. The OLED device of claim 1, wherein the carry clocks include 16 carry clocks, the scan clocks include 12 scan clocks, and each cycle includes 60 horizontal periods, and first to 16th carry clocks are sequentially output for 60 horizontal periods, from a first horizontal period until a 60th horizontal period, wherein a first half of one cycle of the first to eighth carry clocks corresponds to the image clock signal of the carry clock, and the first half of one cycle of the ninth to 16th carry clocks corresponds to the BDI clock signal of the carry clock.

10. The OLED device of claim 9, wherein there is a time difference of 48n+24 (n is a natural number) horizontal periods between the carry clock signal for writing image data to an ith pixel line (i is a natural number) and the carry clock signal for writing black data to the ith pixel line.

11. The OLED device of claim 1, wherein the carry clocks include 12 carry clocks, the scan clocks include 12 scan clocks, and each cycle includes 60 horizontal periods, first to 12th carry clocks are sequentially output for 60 horizontal periods, from a first horizontal period until a 60th horizontal period, and wherein a first half of one cycle of the first to sixth carry clocks corresponds to the image clock signal of the carry clock, and the first half of one cycle of the seventh to 12th carry clocks corresponds to the BDI clock signal of the carry clock.

12. The active-matrix display device of claim 11, wherein there is a time difference of 48n+24 (n is a natural number) horizontal periods between the carry clock signal for writing image data to an ith pixel line (i is a natural number) and the carry clock signal for writing black data to the ith pixel line.

13. The OLED device of claim 1, wherein each of the plurality of stages comprises:

a first Q node control transistor that charges the Q node in response to a forward carry signal in a forward scan mode; and a second Q node control transistor that discharges the Q node in response to a reverse carry signal in the forward scan mode, wherein output timings of the forward carry signal and reverse carry signal are set longer than a scan time of each of the blocks of the display panel.

14. The active-matrix display device of claim 13, wherein the second Q node control transistor charges the Q node in response to the reverse carry signal in a reverse scan mode, and the first Q node control transistor applies a turn-off voltage to the Q node in response to the forward carry signal in the reverse scan mode.

15. The active-matrix display device of claim 13, wherein each of the plurality of blocks includes 8k pixel lines (k is a natural number), wherein the output timing of the forward carry signal applied to the first Q node control transistor of a (8k+a)th stage (a is a natural number less than or equal to 8) and the output timing of the reverse carry signal applied to the second Q node control transistor of a (8k+[9−a])th stage are the same.

16. The active-matrix display device of claim 15, wherein the output timing of the reverse carry signal applied to the second Q node control transistor of the (8k+a)th stage (a is a natural number less than or equal to 8) and the output timing of the forward carry signal applied to the first Q node control transistor of the (8k+[9−a])th stage are the same.

17. A gate-in-panel (GIP) gate driver, comprising:

a plurality of stages, each of the stages including:

a first pull-up transistor that receives a respective carry clock and outputs carry signals corresponding to the carry clock in response to a Q node voltage of the stage;

a second pull-up transistor that receives a respective scan clock and outputs scan signals corresponding to the scan clock in response to the Q node voltage;

a first Q node control transistor that charges the Q node in response to a forward carry signal in a forward scan mode; and a second Q node control transistor that discharges the Q node in response to a reverse carry signal in the forward scan mode, wherein each of the carry clocks includes:

an image clock signal for generating a respective one of the scan signals that are output during a data writing period; and a black data insertion (BDI) clock signal for generating a respective one of the scan signals that are output during a black data insertion period.

18. The gate driver of claim 17, wherein the carry clocks maintain a turn-off voltage during the black data insertion period.

19. The gate driver of claim 17, wherein the black data insertion period lasts for 1 horizontal period.

* * * * *